US008674973B2

(12) United States Patent
Takada et al.

(10) Patent No.: US 8,674,973 B2
(45) Date of Patent: Mar. 18, 2014

(54) LIQUID CRYSTAL DISPLAY DEVICE EMPLOYING DOT INVERSION DRIVE METHOD WITH REDUCED POWER CONSUMPTION

(75) Inventors: Naoki Takada, Yokohama (JP); Naruhiko Kasai, Yokohama (JP); Norio Mamba, Kawasaki (JP); Mitsuru Goto, Chiba (JP); Shuuichirou Matsumoto, Mobara (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 653 days.

(21) Appl. No.: 12/844,877

(22) Filed: Jul. 28, 2010

(65) Prior Publication Data

US 2011/0050553 A1 Mar. 3, 2011

(30) Foreign Application Priority Data

Aug. 26, 2009 (JP) ..... 2009-195289

(51) Int. Cl.
*G09G 5/00* (2006.01)
*G09G 3/36* (2006.01)

(52) U.S. Cl.
USPC ..... 345/211; 345/96

(58) Field of Classification Search
USPC ..... 345/96, 87, 204, 209, 211, 212
See application file for complete search history.

(56) References Cited

U.S. PATENT DOCUMENTS

| | | | | |
|---|---|---|---|---|
| 2003/0132903 | A1 | 7/2003 | Ueda | |
| 2004/0178981 | A1 * | 9/2004 | Asada et al. | 345/96 |
| 2005/0168425 | A1 | 8/2005 | Takada et al. | |
| 2008/0100603 | A1 | 5/2008 | Matsuda et al. | |

FOREIGN PATENT DOCUMENTS

| | | |
|---|---|---|
| JP | 2003-207760 | 7/2003 |
| JP | 2005-215317 | 8/2005 |
| JP | 2008-116556 | 5/2008 |

* cited by examiner

*Primary Examiner* — Chanh Nguyen
*Assistant Examiner* — John Kirkpatrick
(74) *Attorney, Agent, or Firm* — Antonelli, Terry, Stout & Kraus, LLP.

(57) ABSTRACT

A liquid crystal display device employing a dot inversion drive method includes a pixel array, a data driver circuit, a short circuit, and a scanning circuit. The short circuit is disposed for respective outputs of the data driver circuit, and includes a switching element for connecting each of the outputs to a precharge voltage different from an output voltage. The short circuit includes the switching element disposed in one of a first switching group and a second switching group; the switching element of one of the first switching group and the second switching group is connected to respective pairs of pixel column units including an odd-numbered pixel column and an even-numbered pixel column which are adjacent to each other; and the pairs of pixel column units which are adjacent to each other are each connected to the switching element disposed in respective switching groups different from each other.

12 Claims, 18 Drawing Sheets

8n+1 FRAME

8n+2 FRAME

8n+3 FRAME

8n+4 FRAME

8n+5 FRAME

8n+6 FRAME

8n+7 FRAME

8n+8 FRAME

4n+1 FRAME

4n+2 FRAME

4n+3 FRAME

4n+4 FRAME

16n+1 FRAME

16n+2 FRAME

16n+3 FRAME

16n+4 FRAME

16n+5 FRAME

16n+6 FRAME

16n+7 FRAME

16n+8 FRAME

16n+9 FRAME

16n+10 FRAME

16n+11 FRAME

16n+12 FRAME

16n+13 FRAME

16n+14 FRAME

16n+15 FRAME

16n+16 FRAME

1 × 4 DOT INVERSION

DRIVE IN WHICH POLARITY INVERSION POSITIONS ARE DISPERSED IN 1 × 4 DOT INVERSION

LIQUID CRYSTAL DISPLAY DEVICE EMPLOYING DOT INVERSION DRIVE METHOD WITH REDUCED POWER CONSUMPTION

CROSS-REFERENCE TO RELATED APPLICATION

The present application claims priority from Japanese patent application JP 2009-195289 filed on Aug. 26, 2009, the content of which is hereby incorporated by reference into this application.

BACKGROUND OF THE INVENTION

1. Field of the Invention

The present invention relates to a liquid crystal display device, and more particularly, to a liquid crystal display device employing dispersion type N (N≥2) dot inversion drive, in which polarities are inverted every N lines and there exist columns having polarity inversion lines located at positions different from each other.

2. Description of the Related Art

There has been employed dot inversion drive which inverts polarities for every adjacent pixel, as means for improving image quality of an active matrix display device. Conventionally, the dot inversion drive has been generally employed in large-sized panels for TV. In recent years, however, improvement of the image quality is also highly required for small/medium-sized panels for mobile equipment, and use thereof is increased. However, the dot inversion drive has a problem in that a large amount power is consumed due to charge/discharge. In the small/medium-sized panels for mobile equipment, in particular, achieving low power consumption is one of the most important requirements.

JP 2003-207760 A (hereinafter, referred to as Patent Document 1) discloses a technology for realizing the low power consumption. According to the technology described in Patent Document 1, as illustrated in FIG. 12, charge/discharge power consumption of a panel becomes 1/N by performing 1×N (N≥2) dot inversion drive. However, for example, when a tone of white is displayed on an entire liquid crystal panel 401, a line performing polarity inversion has heavier loads of a capacitance component (C) and a resistance component (R) in the panel compared with a line not performing polarity inversion, and hence insufficiency of writing may easily occur. Therefore, horizontal streaks and horizontal flicker due to the insufficiency of writing may occur in polarity inversion positions 402. In Patent Document 1, there is proposed a method in which voltages are applied to subpixels 401 in lines after inversion of polarities of the applied voltages for a longer time than in the remainder of the lines after inversion of polarities of the applied voltages. However, because 1 line period is short in a high definition panel, there is a fear that sufficient voltage applying time period may not be ensured. Therefore, there is a fear that horizontal streaks and horizontal flicker due to the insufficiency of writing may not be eliminated.

As a technology for solving the problem involved in Patent Document 1 described above, there is a technology described in JP 2005-215317 A (hereinafter, referred to as Patent Document 2). In the technology described in Patent Document 2, as illustrated in FIG. 13, there is proposed a method in which the lines performing polarity inversion are located at different positions in each column (pixel class including grouped subpixels 401). In this case, the polarity inversion positions 402 at which insufficiency of writing may occur are different in each column, that is, the polarity inversion positions 402 are spatially dispersed within the liquid crystal panel 401. Therefore, it is predictable that horizontal streaks and horizontal flicker may be prevented.

Further, JP 2008-116556 A (hereinafter, referred to as Patent Document 3) discloses a technology for realizing low power consumption. In the technology described in Patent Document 3, as illustrated in FIG. 14, a short circuit 206 for pre-charging is provided in an output section of a decoding circuit 205 for generating gray scale voltages in accordance with gray scale signals input from outside. The short circuit 206 includes switches for short-circuiting each output to a precharge voltage having the same polarity for a predetermined time period. In this manner, each output is short-circuited to the precharge voltage in the dot inversion drive, to thereby reduce power necessary to reach the precharge voltage, and hence low power consumption is achieved. For example, as illustrated in FIG. 15, in a case where a voltage in a range of −5 V to 0 V is output with negative polarity and a voltage in a range of 0 V to 5 V is output with positive polarity, all outputs are short-circuited to the ground level (0 V). A voltage level of the opposite polarity is output in the preceding line, and hence it is possible to reduce power necessary for increasing the voltage level from −5 V to 0 V at maximum when positive polarity writing is performed, and it is also possible to reduce power necessary for decreasing the voltage level from 5 V to 0 V at maximum when negative polarity writing is performed.

When the technology described in Patent Document 1 is combined with the technology described in Patent Document 3, there may be expected to achieve a large power consumption reduction effect. However, there is a possibility that image quality deterioration such as horizontal streaks and horizontal flicker as described above may occur. On the other hand, the technology described in Patent Document 2 and the technology described in Patent Document 3 may be combined, so that a large power consumption reduction effect may be achieved while suppressing deterioration in image quality.

However, the technology described in Patent Document 2 is difficult to combine with a precharge/short-circuit drive of the technology described in Patent Document 3, because polarity alternating points differ in each column. That is, in 1×4 dot inversion as illustrated in FIG. 13, in a case where the technology described in Patent Document 3 is employed when an output performing polarity inversion and an output not performing polarity inversion are mixed, power is necessary for causing the output not performing polarity inversion (case where the preceding line is positive and the writing line is positive, or both are negative) to once reach the voltage level of the opposite polarity. For example, in the case where the preceding line is positive and the writing line is positive, the power for increasing the voltage level, which is once short-circuited to the ground to be 0 V, to 5 V at maximum is necessary. Further, in the case where the preceding line is negative and the writing line is negative, the power for decreasing the voltage level, which is once short-circuited to the ground to be 0 V, to −5 V at maximum is necessary. Therefore, extra power is necessary, leading to a fear that the large power consumption reduction effect may be diminished.

SUMMARY OF THE INVENTION

The present invention has been made in view of the above, and therefore, it is an object of the present invention to provide a liquid crystal display device capable of achieving a large power consumption reduction effect while employing a polarity inversion line dispersion type dot inversion drive method which suppresses deterioration in image quality.

(1) In order to solve the above-mentioned problems, there is provided a liquid crystal display device including: a pixel array including a plurality of pixels arranged in matrix, the plurality of pixels forming pixel rows and pixel columns; a data driver circuit for supplying gray scale voltages in accordance with display data to the plurality of pixels; a short circuit disposed for respective outputs of the data driver circuit, the short circuit including a switching element for connecting each of the outputs to a precharge voltage different from an output voltage; and a scanning circuit for supplying a scanning signal for selecting, from among the plurality of pixels, pixels in a line unit of each of the pixel rows, the liquid crystal display device employing a dot inversion drive method which inverts polarities of the gray scale voltages for at least every 2 pixel rows, in which: the short circuit includes the switching element disposed in one of a first switching group and a second switching group; the switching element of one of the first switching group and the second switching group is connected to respective pairs of pixel column units including an odd-numbered pixel column and an even-numbered pixel column which are adjacent to each other; and the pairs of pixel column units which are adjacent to each other are each connected to the switching element disposed in respective switching groups different from each other.

(2) In order to solve the above-mentioned problems, there is provided a liquid crystal display device including: a pixel array including a plurality of pixels arranged in matrix; a data driver circuit for supplying gray scale voltages in accordance with display data to the plurality of pixels; a short circuit for short-circuiting respective outputs of the data driver circuit to a precharge voltage different from an output voltage; and a scanning circuit for supplying a scanning signal to the plurality of pixels, for selecting, from among the plurality of pixels, pixels to be supplied with the gray scale voltages in a row unit, the liquid crystal display device employing a 1×N dot inversion drive method, where which inverts polarities of the gray scale voltages in the pixel array for every plurality of lines, in which: the 1×N dot inversion drive method, where N≥2, comprises of a polarity inversion line dispersion type which has polarity inversion lines located at positions different in respective columns; and the 1×N dot inversion drive method, where N≥2, of the polarity inversion line dispersion type has a polarity pattern that, among a number of outputs 4M+4, where M is an integer equal to or larger than 0, of the data driver circuit, a pair of an output 4M+1 and an output 4M+2 has the same polarity inversion line, a pair of an output 4M+3 and an output 4M+4 has the same polarity inversion line, and the polarity inversion line of the pair of the output 4M+1 and the output 4M+2 and the polarity inversion line of the pair of the output 4M+3 and the output 4M+4 are shifted by N/2 lines.

The liquid crystal display device according to the present invention is capable of achieving a large power consumption reduction effect while employing a polarity inversion line dispersion type dot inversion drive method which suppresses deterioration in image quality.

Other effects of the present invention may be apparent from descriptions in the entire specification.

DETAILED DESCRIPTION OF THE INVENTION

Hereinafter, embodiments to which the present invention is applied are described with reference to the attached drawings. Note that, in the following description, the same components are denoted by the same reference symbols, and repetition of explanation thereof is omitted.

First Embodiment

[Entire Configuration]

Figure 1:
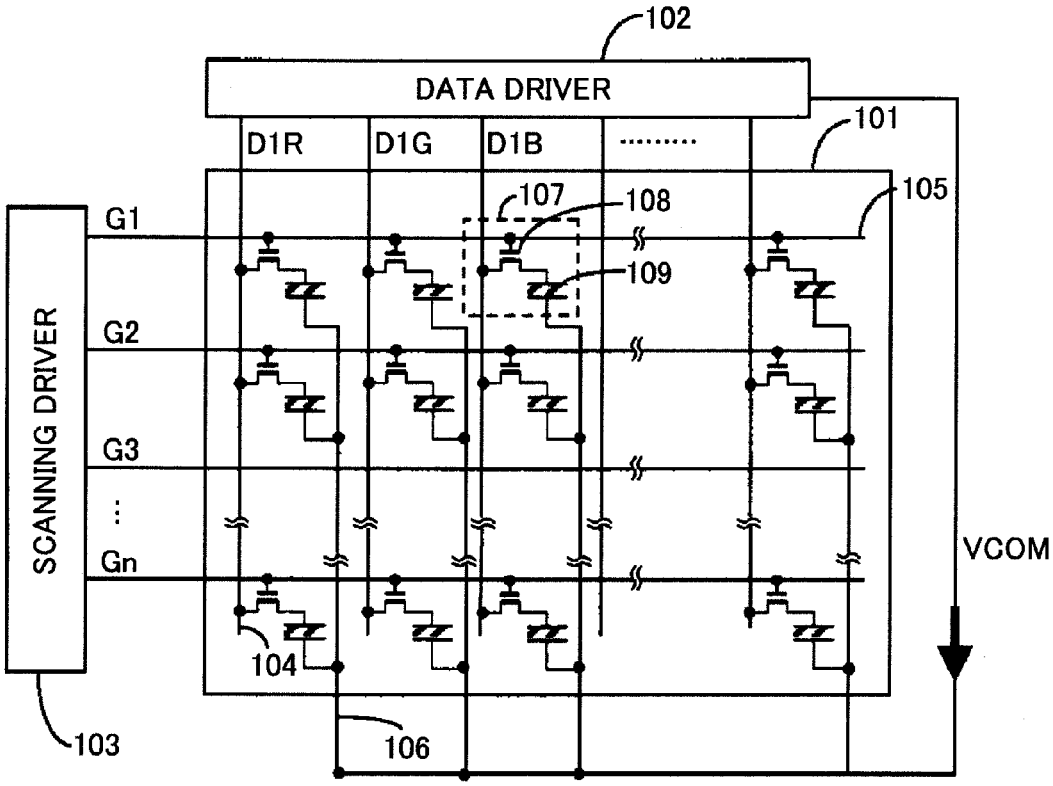
FIG. 1 is a diagram for describing a schematic configuration of a liquid crystal display device according to a first embodiment of the present invention.

FIG. 1 is a diagram for describing a schematic configuration of a liquid crystal display device according to a first embodiment of the present invention. Hereinafter, with reference to FIG. 1, an entire configuration of an active matrix liquid crystal display device of the first embodiment is described. Note that, in the liquid crystal display device illustrated in FIG. 1, a configuration other than a data driver 102 is the same as that of the conventional liquid crystal display device. Therefore, in the following description, the data driver 102, which is a feature of the present application, is described in detail. Further, in the liquid crystal display device of the first embodiment, a case where the present application is applied to a liquid crystal display device which displays an image in normally black mode is described. However, the present invention is also applicable to a liquid crystal display device which displays an image in normally white mode with a modified pixel configuration. Note that, in this specification, among pixels disposed in a liquid crystal array, a pixel group which includes pixels performing polarity inversion at the same timing and being disposed adjacently to one another is referred to as "column".

As illustrated in FIG. 1, the liquid crystal display device according to the first embodiment of the present invention includes a plurality of pixels 107 arranged two-dimensionally or in matrix. The plurality of pixels 107 each include a liquid crystal capacitor 109 and a switching element 108 (for example, thin film transistor) for supplying an image signal to the liquid crystal capacitor 109. An element including the plurality of pixels 107 arranged as described above is also referred to as pixel array 101, and the pixel array in the liquid crystal display device is also referred to as liquid crystal display device panel. In this pixel array, the plurality of pixels 107 constitute a so-called screen for displaying an image.

In the pixel array 101 illustrated in FIG. 1, a plurality of gate lines 105 (also referred to as scanning signal lines) extending in a horizontal direction and a plurality of data lines 104 (also referred to as image signal lines) extending in a vertical direction (direction orthogonal to gate lines 105) are disposed in parallel. As illustrated in FIG. 1, a so-called pixel row is formed along each of the gate lines 105 labeled G1, G2, G3, . . . , Gn, the pixel row including the plurality of pixels 107 arranged in the horizontal direction. Further, a so-called pixel column is formed along each of the data lines 104 labeled D1R, D1G, D1B, . . . , the pixel column including the plurality of pixels 107 arranged in the vertical direction. Each of the gate lines 105 applies a voltage signal to the switching elements 108 formed in the respective pixels 107 constituting a corresponding one of the pixel rows (illustrated on the downside of each one of gate lines 105 in FIG. 1) from a scanning driver 103 (also referred to as scanning drive circuit), to thereby open or close electrical connection between the liquid crystal capacitor 109 formed in each pixel 107 and corresponding one of the data lines 104. An operation controlling a group of the switching elements SW provided in a particular pixel row by applying a voltage signal (selection voltage) from a corresponding one of the gate lines 105 is referred to as line selection or scanning, and the above-mentioned voltage signal applied to the gate lines 105 from the scanning driver 103 is also referred to as scanning signal or gate signal.

On the other hand, a voltage signal which is also referred to as gray scale voltage (or tone voltage) is applied to each of the data lines 104 from a data driver 102 (also referred to as image signal drive circuit), to thereby apply the gray scale voltage to each of the pixel electrodes in the pixels 107 constituting a corresponding one of the pixel columns (illustrated on the right-hand side of each of the data lines 104 in FIG. 1) and being selected by the scanning signal. The data driver 102 is disposed on one side of the pixel array 101. Therefore, the data driver 102 may output a gray scale voltage for only one row at a time. The liquid crystal capacitor 109 of each of the pixels 107 has one end connected to the data line 104 via the switching element 108 and another end connected to a common line 106 supplying a reference voltage or a common voltage from a common electrode. With this configuration, light transmittance of a liquid crystal layer (not shown) may be controlled by a voltage applied to the data line 104 and the common line 106, that is, a voltage retained in the liquid crystal capacitor 109 and applied between a pixel electrode and a common electrode. In this case, a circuit supplying the common voltage corresponds to the data driver 102, and has a configuration that the common line 106 is connected to the common electrode (not shown) disposed to face the pixel electrode. That is, in the pixels of the first embodiment, the liquid crystal capacitor 109 is a capacitor formed by the pixel electrode and the common electrode which are disposed to face each other via a capacitive insulating film. Molecules of liquid crystal are controlled by an electric field generated between the pixel electrode and the common electrode, and thus the transmittance thereof is controlled.

[Configuration of Data Driver]

Figure 2:
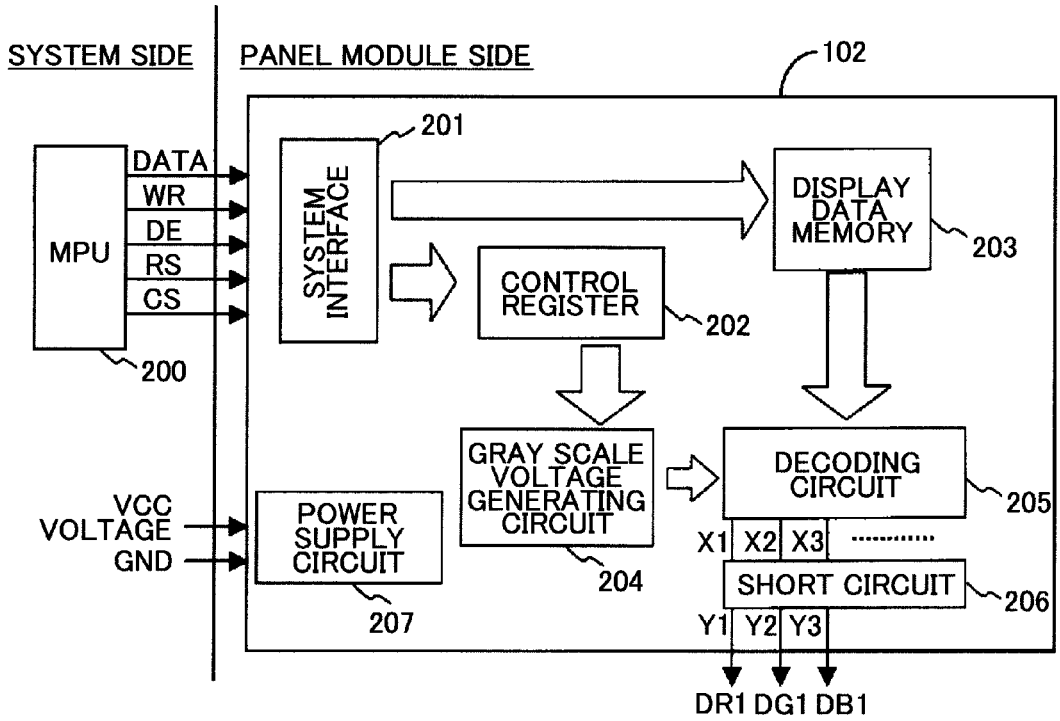
FIG. 2 is a diagram for describing an inner configuration of a data driver of the liquid crystal display device according to the first embodiment of the present invention.

FIG. 2 is a diagram for describing an inner configuration of the data driver in the liquid crystal display device according to the first embodiment of the present invention. Hereinafter, with reference to FIG. 2, the configuration of the data driver, which is a feature of the present invention, is described. However, in the following description, a case where a microprocessor unit (MPU) 200 is used as an external system for inputting display data or a control signal for image display to the liquid crystal display device of the first embodiment is described. However, the external system is not limited to the MPU 200.

As illustrated in FIG. 2, the data driver 102 of the first embodiment includes a system interface 201, a control register 202, display data memory 203, a gray scale voltage generating circuit 204, a decoding circuit 205, a short circuit 206, and a power supply circuit 207.

The system interface 201 performs an operation of receiving display data and instructions output from the MPU 200 that performs various processings so as to display an image on the liquid crystal panel 101, and outputting the received display data and instructions to the control register 202 or the display data memory 203. Here, the instructions are information for determining inner operations of the data driver 102 and the scanning driver 103, and include various parameters such as a frame frequency, the number of drive lines, and a drive voltage.

Further, information related to control of the short circuit 206, which is another feature of the present invention, is stored in the control register 202. Data for one frame stored in the display data memory 203 is transmitted to the decoding circuit 205 in units of lines. The decoding circuit 205 has the same number of outputs as outputs of the data driver 102, in which D/A conversion are performed for converting digital data into a gray scale voltage to be applied to the liquid crystal capacitor. Here, the gray scale voltage corresponds to a voltage level generated by the gray scale voltage generating circuit 204. When the digital data of the display data is 8 bits, gray scale voltages in 256 levels are generated in the gray scale voltage generating circuit 204.

The outputs of the decoding circuit 205 are input into corresponding inputs X1, X2, X3, . . . of the short circuit 206.

Outputs Y1, Y2, Y3, . . . of the short circuit 206 are connected to the corresponding data lines D1R, D1G, D1B . . . of the liquid crystal panel 101. Note that, inner configuration of the short circuit 206 is described later.

The power supply circuit 207 generates voltages necessary in the data driver 102 by using a voltage VCC input from outside (system side) and a ground level. Here, in a case of a liquid crystal display panel of a small/medium-sized LCD, voltages necessary in the data driver 102 include a digital circuit voltage and an analog circuit voltage. The digital circuit voltage is a power supply voltage used for the system interface 201, the control register 202, and the display data memory 203, and generally has a small voltage level (3 V or smaller). The analog circuit voltage is a power supply voltage used mainly for the gray scale voltage generating circuit 204, the decoding circuit 205, and the short circuit 206, and generally has a large voltage level (5 V to 6 V).

Further, in the first embodiment, as described above, the data driver 102 and the scanning driver 103 are formed of different large scale integrations (LSIs). However, in a case where the data driver 102 and the scanning driver 103 are integrally formed in the same LSI, a gate voltage is also generated. Voltage levels of HIGH and LOW of the gate signal are generally set to be values larger than the analog voltage, and may be, for example, HIGH level=15 V and LOW level=−10 V.

Further, in the first embodiment, the display data has 8 bits of information, but the present invention is not limited thereto. Further, in the first embodiment, a concept of colors is omitted for ease of description. However, color display may be easy to realize by, for example, configuring display data of one pixel with red (R), green (G), and blue (B), and adopting a so-called vertical stripe pattern to a display section. That is, pixels 107 of red (R), green (G), and blue (B) formed in the pixel array 101 form a unit pixel for color display. Therefore, each output of the data driver 102 outputs the display data corresponding to each of the pixels 107 of RGB.

[Configuration of Short Circuit]

Figure 3:
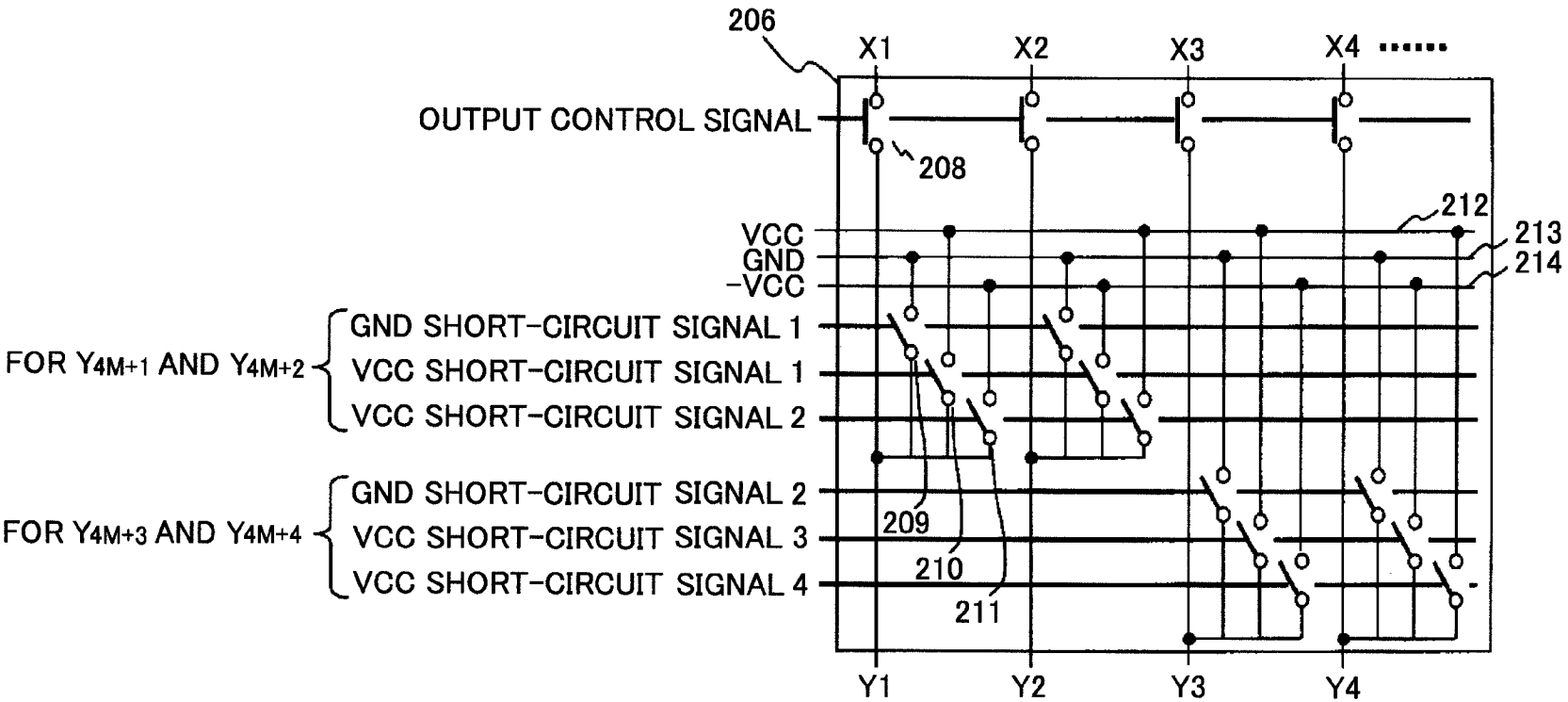
FIG. 3 is a diagram for describing an inner configuration of a short circuit of the liquid crystal display device according to the first embodiment of the present invention.

FIG. 3 is a diagram for describing an inner configuration of the short circuit of the liquid crystal display device according to the first embodiment of the present invention. Hereinafter, with reference to FIG. 3, the configuration of the short circuit, which is a further feature according to the first embodiment of the present invention, is described. Note that, in the following description, VCC short-circuit signals 1 and 3 represent signals of a VCC level on a positive polarity side (+VCC), and VCC short-circuit signals 2 and 4 represent signals of a VCC level on a negative polarity side (−VCC). Further, GND short-circuit signals 1 and 2 represent signals of a GND level, that is, zero (0) V.

As illustrated in FIG. 3, in the short circuit 206 of the first embodiment, an input switch (SW) 208 is provided between an input Xm (where m is a natural number, such as 1, 2, 3, . . . ) and an output Ym (where m is a natural number, such as 1, 2, 3, . . . ). The input SW 208 is used for turning OFF a conduction state between the input Xm side and the output Ym during a short-circuit operation of the output Ym as described later. Between the input SW 208 and the output Ym, a ground short-circuit SW 209 for establishing a short circuit to the ground, a VCC short-circuit SW 210 for establishing a short circuit to the VCC voltage, and a −VCC short-circuit SW 211 for establishing a short circuit to the −VCC voltage are formed. A SW group including the input SW 208 and the SWs 209 to 211 controls the output voltage of each output Ym. Note that, for example, a known metal oxide semiconductor field effect transistor (MOSFET) may be used as the SW group of the first embodiment in view of low power consumption, but the SW group is not limited thereto.

As illustrated in FIG. 3, the SW group is provided for each output, and a control line for the input SW 208 is controlled by an output control signal common with respect to each output. On the other hand, control lines for the respective SWs 209 to 211 are different in each output. That is, in the first embodiment, a pair of outputs $Y_{4M+1}$ and $Y_{4M+2}$ (where M is an integer equal to or larger than 0, such as 0, 1, 2, . . . ) (Y1 and Y2, Y5 and Y6, Y9 and Y10, . . . ) are controlled by using the ground (GND) short-circuit signal 1, the VCC short-circuit signal 1, and the VCC short-circuit signal 2. Further, a pair of outputs $Y_{4M+3}$ and $Y_{4M+4}$ (where M is an integer equal to or larger than 0, such as 0, 1, 2, . . . ) (Y3 and Y4, Y7 and Y8, Y11 and Y12, . . . ) are controlled by using the ground (GND) short-circuit signal 2, the VCC short-circuit signal 3, and the VCC short-circuit signal 4.

Next, connection of the control lines and the SW groups is described. The GND short-circuit signal 1 is connected to a gate of the ground short-circuit SW 209 in both outputs $Y_{4M+1}$ and $Y_{4M+2}$. The VCC short-circuit signal 1 is connected to a gate of the VCC short-circuit SW 210 in the output $Y_{4M+1}$ and is connected to a gate of the −VCC short-circuit SW 211 in the output $Y_{4M+2}$. The VCC short-circuit signal 2 is connected to the gate of the −VCC short-circuit SW 211 in the output $Y_{4M+1}$, and is connected to the gate of the VCC short-circuit SW 210 in the output $Y_{4M+2}$.

Further, the GND short-circuit signal 2 is connected to the gate of the ground short-circuit SW 209 in both outputs $Y_{4M+3}$ and $Y_{4M+4}$. The VCC short-circuit signal 3 is connected to the gate of the VCC short-circuit SW 210 in the output $Y_{4M+3}$, and is connected to the gate of the −VCC short-circuit SW 211 in the output $Y_{4M+4}$. The VCC short-circuit signal 4 is connected to the gate of the −VCC short-circuit SW 211 in the output $Y_{4M+3}$, and is connected to the gate of the VCC short-circuit SW 210 in the output $Y_{4M+4}$.

With this configuration, in the first embodiment, a short-circuit operation may be realized only at columns in which polarities are inverted, even when polarity inversion lines of the outputs $Y_{4M+1}$ and $Y_{4M+2}$ and the outputs $Y_{4M+3}$ and $Y_{4M+4}$ are located at positions different from each other.

[Operation of Short Circuit]

Figure 4:
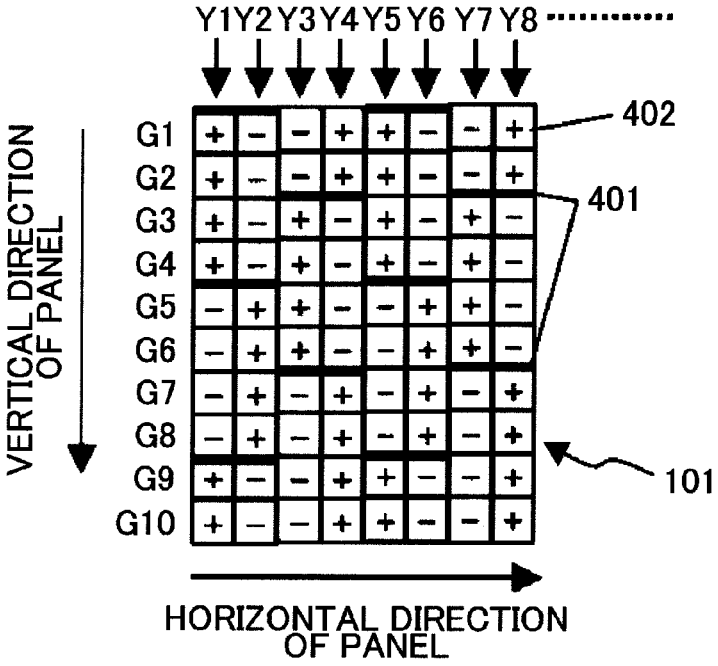
FIG. 4 is a diagram for describing a polarity distribution in the liquid crystal display device according to the first embodiment of the present invention when 1×4 dot inversion drive is performed.
Figure 5:
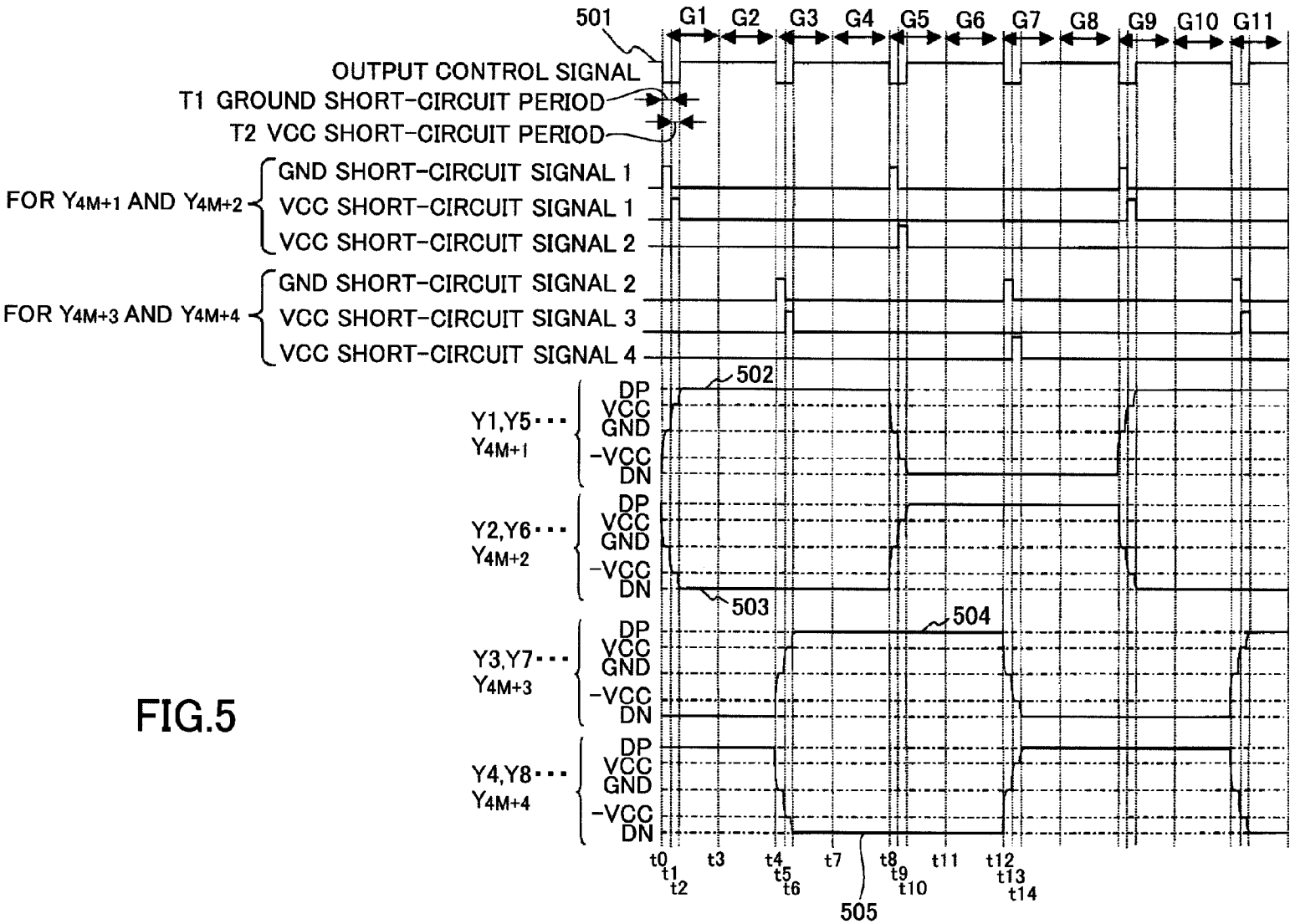
FIG. 5 is a timing chart of signal lines of the short circuit of the liquid crystal display device according to the first embodiment of the present invention when 1×4 dot inversion drive is performed.
Figure 6A:
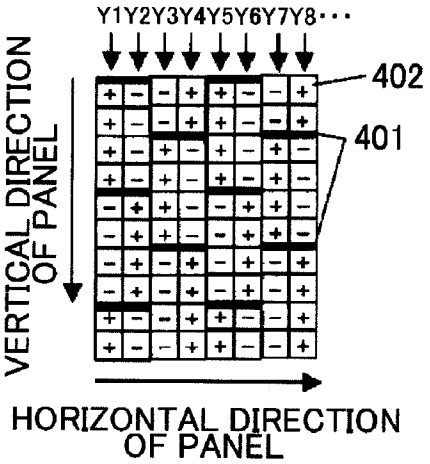
FIGS. 6A to 6H are diagrams illustrating voltage polarity distributions on successive frames in the liquid crystal display device according to the first embodiment of the present invention.
Figure 6B:
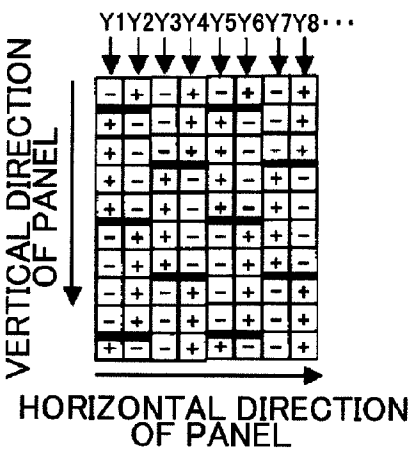
Figure 6C:
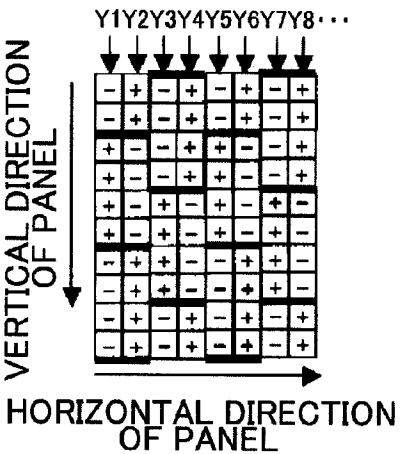
Figure 6D:
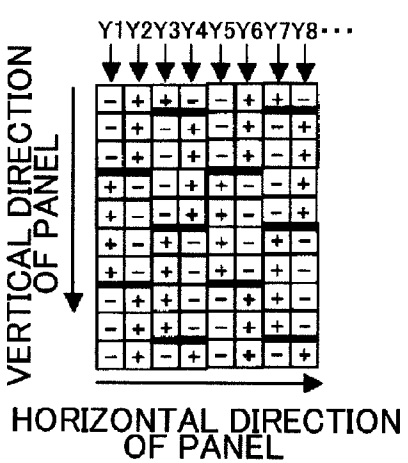
Figure 6E:
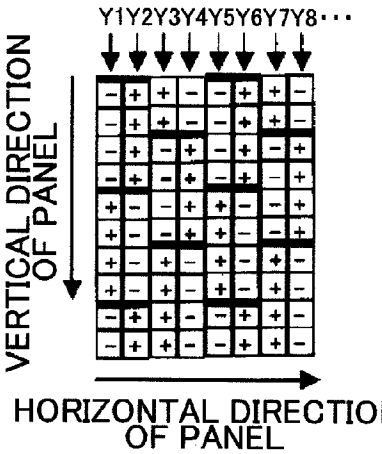
Figure 6F:
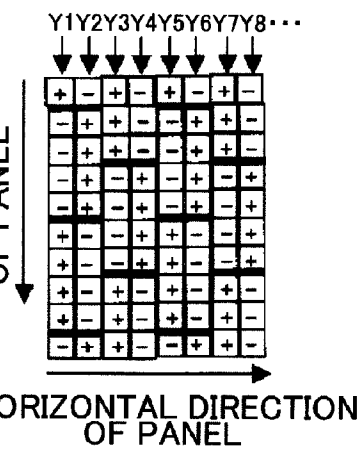
Figure 6G:
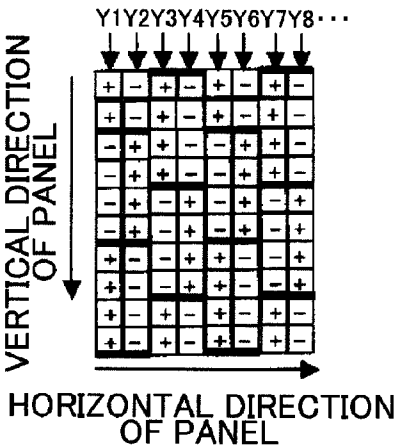
Figure 6H:
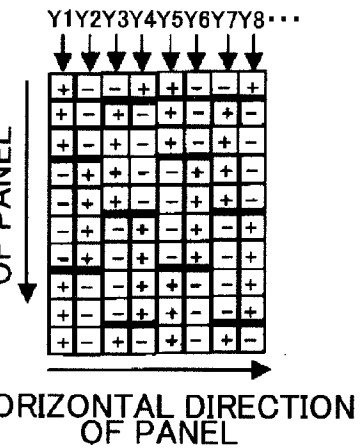
Figure 7A:
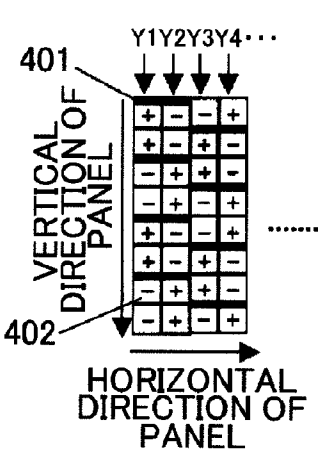
FIGS. 7A to 7D are diagrams illustrating voltage polarity distributions on successive frames in a liquid crystal display device according to a second embodiment of the present invention.
Figure 7B:
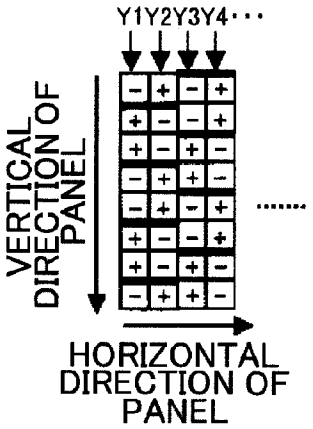
Figure 7C:
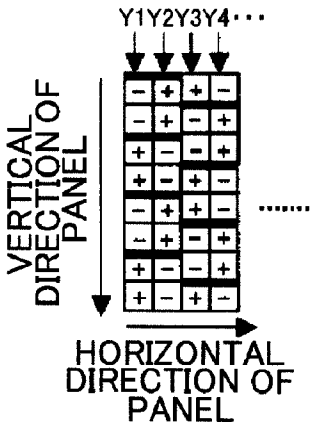
Figure 7D:
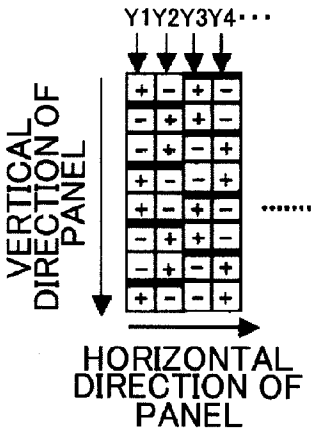

FIG. 4 illustrates a polarity distribution diagram in the liquid crystal display device according to the first embodiment of the present invention when 1×4 dot inversion drive is performed. FIG. 5 is a timing chart of the signal lines in the short circuit of the liquid crystal display device according to the first embodiment of the present invention when 1×4 dot inversion drive is performed. Hereinafter, with reference to FIGS. 4 and 5, an operation of the short circuit of the first embodiment is described. Note that, FIG. 4 is a diagram enlarging a part of a region of the liquid crystal panel 101, in which "+" and "−" indicate polarities. Each of "+" and "−" corresponds to one of the pixels (sub-pixels) of RGB. Further, scanning timings of a G1 line, a G2 line, a G3 line, . . . illustrated in FIG. 4 correspond to a G1 period, a G2 period, a G3 period, . . . that is, each one horizontal cycle (1H cycle), illustrated in FIG. 5.

As is apparent from FIG. 4, in the polarity distribution when 1×4 dot inversion drive is performed, in a case where the number of outputs of the data driver is 4M+4 (where M is an integer equal to or larger than 0), the outputs $Y_{4M+1}$ and $Y_{4M+2}$ in a pair have the same polarity inversion line, and further, the outputs $Y_{4M+3}$ and $Y_{4M+4}$ in a pair have the same polarity inversion line. Further, the polarity inversion line of the outputs $Y_{4M+1}$ and $Y_{4M+2}$ in a pair and the polarity inversion line of the outputs $Y_{4M+3}$ and $Y_{4M+4}$ in a pair are shifted by N/2 (where N is the number of lines performing polarity inversion of a gray scale voltage). Therefore, as illustrated in FIG. 4, the polarity inversion lines are shifted by 2 lines when 4 line inversion is performed.

That is, as illustrated in FIG. 4, with respect to each pixel (sub-pixel) 402 formed in the pixel array 101, the polarity inversion cycle is 4 line cycle in all the columns in all the frames. In the first line G1, the output $Y_{4M+1}$ is a positive voltage output (output $Y_{4M+2}$ is a negative voltage output), and the output $Y_{4M+3}$ is a negative voltage output (output $Y_{4M+4}$ is a positive voltage output). Further, a position to serve as a polarity inversion line 401 in each column of the pair of the outputs $Y_{4M+1}$ and $Y_{4M+2}$ is set to start from the first line G1, and a position to serve as the polarity inversion line 401 in each column of the pair of the outputs $Y_{4M+3}$ and $Y_{4M+4}$ is set to start from the third line G3.

Next, with reference to FIG. 5, the operation of the short circuit in the case where 1×4 dot inversion drive is performed as illustrated in FIG. 4 is described. FIG. 5 illustrates a timing chart of the signal lines of the short circuit and an operation of a drain line of each output (Y1, Y2, Y3, . . . ).

As is apparent from FIG. 5, an output control signal 501 becomes LOW for every 2 horizontal cycles (2H cycles), for example, so as to turn OFF the input SW 208 formed of a known n-channel metal oxide semiconductor (NMOS). The output control signal 501 becomes LOW in a period T1 when the outputs $Y_{4M+1}$ and $Y_{4M+2}$ or the outputs $Y_{4M+3}$ and $Y_{4M+4}$ are short-circuited to the ground and a period T2 when the outputs $Y_{4M+1}$ and $Y_{4M+2}$ or the outputs $Y_{4M+3}$ and $Y_{4M+4}$ are short-circuited to VCC, in the G1 period, the G3 period, the G5 period, . . . .

The GND short-circuit signal 1, the VCC short-circuit signal 1, and the VCC short-circuit signal 2 are control signal lines for the short circuit of the outputs $Y_{4M+1}$ and $Y_{4M+2}$. In particular, the GND short-circuit signal 1 becomes HIGH for every 4 horizontal cycles (4H cycles) so as to turn ON the ground short-circuit SW 209. The GND short-circuit signal 1 becomes HIGH in the period T1 when the outputs $Y_{4M+1}$ and $Y_{4M+2}$ are short-circuited to the ground in the G1 period, the G5 period, the G9 period, . . . . The VCC short-circuit signal 1 becomes HIGH for every 8 horizontal cycles (8H cycles) so as to turn ON the VCC short-circuit SW 210 or the −VCC short-circuit SW 211. The VCC short-circuit signal 1 becomes HIGH in the period T2 when the outputs $Y_{4M+1}$ and $Y_{4M+2}$ are short-circuited to VCC or short-circuited to −VCC in the G1 period, the G9 period, . . . . The VCC short-circuit signal 2 becomes HIGH for every 8 horizontal cycles (8H cycles) so as to turn ON the VCC short-circuit SW 210 or the −VCC short-circuit SW 211. The VCC short-circuit signal 2 becomes HIGH in the period T2 when the outputs $Y_{4M+1}$ and $Y_{4M+2}$ are short-circuited to VCC or short-circuited to −VCC in the G5 period, the G13 period, . . . .

The GND short-circuit signal 2, the VCC short-circuit signal 3, and the VCC short-circuit signal 4 are control signal lines for the short circuit of the outputs $Y_{4M+3}$ and $Y_{4M+4}$. The GND short-circuit signal 2 becomes HIGH for every 4 horizontal cycles (4H cycles) so as to turn ON the ground short-circuit SW 209. The GND short-circuit signal 2 becomes HIGH in the period T1 when the outputs $Y_{4M+3}$ and $Y_{4M+4}$ are short-circuited to the ground in the G3 period, the G7 period, the G11 period, . . . . The VCC short-circuit signal 3 becomes HIGH for every 8 horizontal cycles (8H cycles) so as to turn ON the VCC short-circuit SW 210 or the −VCC short-circuit SW 211. The VCC short-circuit signal 3 becomes HIGH in the period T2 when the outputs $Y_{4M+3}$ and $Y_{4M+4}$ are short-circuited to VCC or short-circuited to −VCC in the G3 period, the G11 period, . . . . The VCC short-circuit signal 4 becomes HIGH for every 8 horizontal cycles (8H cycles) so as to turn ON the VCC short-circuit SW 210 or the −VCC short-circuit SW 211. The VCC short-circuit signal 4 becomes HIGH in the period T2 when the outputs $Y_{4M+3}$ and $Y_{4M+4}$ are short-circuited to VCC or short-circuited to −VCC in the G7 period, the G15 period, . . . .

The signal lines are controlled as described above, so that the short-circuit operation may be performed separately for the outputs $Y_{4M+1}$ and $Y_{4M+2}$ and the outputs $Y_{4M+3}$ and $Y_{4M+4}$.

Next, with reference to FIGS. 3 to 6, a drive operation of the short circuit of the first embodiment with respect to the pixels in the pixel array is described.

First, at a time t0, the output control signal 501 becomes LOW from HIGH, the input SWs 208 which electrically connect the inputs X1, X2, . . . , Xm of the short circuit 206 and the outputs Y1, Y2, . . . , Ym of the short circuit 206 are turned OFF, and each conduction state between the inputs X1, X2, . . . , Xm and the outputs Y1, Y2, . . . Ym is turned OFF. At this time, the GND short-circuit signal 1 becomes HIGH from LOW, and hence the ground short-circuit SW 209 connected to the GND short-circuit signal 1 is turned ON. Accordingly, each of the outputs Y1, Y5, . . . $Y_{4M+1}$ of the short circuit 206 is electrically connected to a signal line 213 of the GND level (0 V). As a result, output voltages 502 of the outputs Y1, Y5, . . . $Y_{4M+1}$ increase to the GND level (0 V) from a DN level (−5.0 V). Similarly, each of the outputs Y2, Y6, . . . $Y_{4M+2}$ of the short circuit 206 is electrically connected to the signal line 213 of the GND level (0 V). As a result, output voltages 503 of the outputs Y2, Y6, . . . $Y_{4M+2}$ decrease to the GND level (0 V) from a DP level (5.0 V).

At this time, the GND short-circuit signal 2, the VCC short-circuit signal 3, and the VCC short-circuit signal 4 remain in the LOW state. Therefore, the ground short-circuit SW 209 connected to the GND short-circuit signal 2, and the VCC short-circuit SW 210 and the −VCC short-circuit SW 211 connected to the VCC short-circuit signal 3 or the VCC short-circuit signal 4 remain in the OFF state. As a result, changes do not occur in output voltages 504 of the outputs Y3, Y7, . . . $Y_{4M+3}$ and output voltages 505 of the outputs Y4, Y8, . . . $Y_{4M+4}$. Therefore, the output voltage 504 is maintained at the DN level (−5.0 V), and the output voltage 505 is maintained at the DP level (5.0 V).

At a time t1, the output control signal 501 remains in the LOW state, and hence each conduction state between the inputs X1, X2, . . . Xm and the outputs Y1, Y2, . . . Ym is maintained in the OFF state. The GND short-circuit signal 1 becomes LOW from HIGH, and hence the ground short-circuit SW 209 connected to the GND short-circuit signal 1 is turned OFF. On the other hand, the VCC short-circuit signal 1 becomes HIGH from LOW. Therefore, the VCC short-circuit SW 210 connected to the VCC short-circuit signal 1, that is, the VCC short-circuit SW 210 connected to each output Y1, Y5, . . . $Y_{4M+1}$, and the −VCC short-circuit SW 211 connected to the VCC short-circuit signal 1, that is, the −VCC short-circuit SW 211 connected to the each output Y2, Y6, . . . $Y_{4M+2}$, are turned ON.

Accordingly, each of the outputs Y1, Y5, . . . $Y_{4M+1}$ of the short circuit 206 is electrically connected to a signal line 212 of the VCC level. As a result, the output voltages 502 of the outputs Y1, Y5, . . . $Y_{4M+1}$ further increase to the VCC level from the GND level (0 V). On the other hand, each of the outputs Y2, Y6, . . . $Y_{4M+2}$ of the short circuit 206 is electrically connected to a signal line 214 of the −VCC level. As a result, the output voltages 503 of the outputs Y2, Y6, . . . $Y_{4M+2}$ further decrease to the −VCC level from the GND level (0 V).

At the time t1, the GND short-circuit signal 2, the VCC short-circuit signal 3, and the VCC short-circuit signal 4 still remain in the LOW state. Accordingly, similarly to the case of the time t0, changes do not occur in the output voltages 504 of the outputs Y3, Y7, . . . $Y_{4M+3}$ and the output voltages 505 of the outputs Y4, Y8, . . . $Y_{4M+4}$ of the short circuit 206. Therefore, the output voltage 504 is maintained at the DN level (−5.0 V) and the output voltage 505 is maintained at the DP level (5.0 V).

At a subsequent time t2, the VCC short-circuit signal 1 becomes LOW from HIGH, and hence the VCC short-circuit SW 210 and the −VCC short-circuit SW 211 connected to the VCC short-circuit signal 1 are turned OFF. At this time, the output control signal 501 becomes HIGH from LOW, and hence the input SWs 208 are turned ON. Therefore, the inputs X1, X2, . . . Xm of the short circuit 206 and the outputs Y1, Y2, . . . Ym of the short circuit 206 are electrically connected. In other words, the inputs X1, X2, . . . Xm and the outputs Y1, Y2, . . . Ym are brought into the conduction state, respectively.

Here, the time t2 is in the G1 period, and hence, the DP level (5.0 V), which is output from the decoding circuit 205, is input to the inputs X1, X5, . . . $X_{4M+1}$ corresponding to the outputs Y1, Y5, . . . $Y_{4M+1}$ of the short circuit 206, among the inputs X1, X2, . . . Xm of the short circuit 206. As a result, the output voltages 502 of the outputs Y1, Y5, . . . $Y_{4M+1}$ of the short circuit 206 increase to the DP level (5.0 V) from the VCC level. Similarly, the DN level (−5.0 V), which is output from the decoding circuit 205, is input to the inputs X2, X6, . . . $X_{4M+2}$ corresponding to the outputs Y2, Y6, . . . $Y_{4M+2}$ of the short circuit 206, among the inputs X1, X2, . . . Xm of the short circuit 206. As a result, the output voltages 503 of the outputs Y2, Y6, . . . $Y_{4M+2}$ of the short circuit 206 decrease to the DN level (−5.0 V) from the −VCC level.

At the time t2, the GND short-circuit signal 2, the VCC short-circuit signal 3, and the VCC short-circuit signal 4 still remain in the LOW state. Accordingly, similarly to the case of the time t0, changes do not occur in the output voltages 504 of the outputs Y3, Y7, . . . $Y_{4M+3}$ and the output voltages 505 of the outputs Y4, Y8, . . . $Y_{4M+4}$ of the short circuit 206. Therefore, the output voltage 504 is maintained at the DN level (−5.0 V), and the output voltage 505 is maintained at the DP level (5.0 V).

As a result, as illustrated in FIG. 4, the polarities of the pixels 402 in the G1 line become "+−−++−−+ . . . " from the left side of FIG. 4 in the horizontal direction of the panel.

At a time t3, the polarity inversion does not occur, and hence changes do not occur in the output voltages 502 of the outputs Y1, Y5, . . . $Y_{4M+1}$ and the output voltages 505 of the outputs Y4, Y8, . . . $Y_{4M+4}$ of the short circuit 206. Therefore, the output voltage 502 and the output voltage 505 are maintained at the DP level (5.0 V), which is the output voltage of the decoding circuit 205. Similarly, changes do not occur in the output voltages 503 of the outputs Y2, Y6, . . . $Y_{4M+2}$ and the output voltages 504 of the outputs Y3, Y7, . . . $Y_{4M+3}$ of the short circuit 206. Therefore, the output voltage 503 and the output voltage 504 are maintained at the DN level (−5.0 V), which is the output voltage of the decoding circuit 205.

As a result, as illustrated in FIG. 4, the pixels 402 in the G2 line maintain polarities similar to those in the G1 line, which are "+−−++−−+ . . . " from the left side of FIG. 4 in the horizontal direction of the panel.

At a subsequent time t4, the output control signal 501 becomes LOW from HIGH, and hence the input SWs 208 are turned OFF. Therefore, each conduction state between the inputs X1, X2, . . . Xm and the outputs Y1, Y2, . . . Ym is turned OFF. At this time, the GND short-circuit signal 2 becomes HIGH from LOW, and hence the ground short-circuit SW 209 connected to the GND short-circuit signal 2 is turned ON. As a result, each of the outputs Y3, Y7, . . . $Y_{4M+3}$ of the short circuit 206 is electrically connected to the signal line 213 of the GND level (0 V). As a result, the output voltages 504 of the outputs Y3, Y7, . . . $Y_{4M+3}$ increase to the GND level (0 V) from the DN level (−5.0 V). Similarly, each of the outputs Y4, Y8, . . . $Y_{4M+4}$ of the short circuit 206 is electrically connected to the signal line 213 of the GND level (0 V). As a result, the output voltages 505 of the outputs Y4, Y8, . . . $Y_{4M+4}$ decrease to the GND level (0 V) from the DP level (5.0 V).

At this time, the GND short-circuit signal 1, the VCC short-circuit signal 1, and the VCC short-circuit signal 2 remain in the LOW state. Therefore, the ground short-circuit SW 209 connected to the GND short-circuit signal 1, and the VCC short-circuit SW 210 and the −VCC short-circuit SW 211 connected to the VCC short-circuit signal 1 or the VCC short-circuit signal 2 remain in the OFF state. As a result, changes do not occur in output voltages 502 of the outputs Y1, Y5, . . . $Y_{4M+1}$ and output voltages 503 of the outputs Y2, Y6, . . . $Y_{4M+2}$. Therefore, the output voltage 502 is maintained at the DP level (5.0 V), and the output voltage 503 is maintained at the DN level (−5.0 V).

At a time t5, the output control signal 501 remains in the LOW state, and hence each conduction state between the inputs X1, X2, . . . Xm and the outputs Y1, Y2, . . . Ym is maintained in the OFF state. The GND short-circuit signal 2 becomes LOW from HIGH, and hence the ground short-circuit SW 209 connected to the GND short-circuit signal 2 is turned OFF. On the other hand, the VCC short-circuit signal 3 becomes HIGH from LOW. Therefore, the VCC short-circuit SW 210 connected to the VCC short-circuit signal 3, that is, the VCC short-circuit SW 210 connected to each output Y3, Y7, . . . $Y_{4M+3}$, and the −VCC short-circuit SW 211 connected to the VCC short-circuit signal 3, that is, the −VCC short-circuit SW 211 connected to the each output Y4, Y8, . . . $Y_{4M+4}$ are turned ON.

Accordingly, each of the outputs Y3, Y7, . . . $Y_{4M+3}$ of the short circuit 206 is electrically connected to the signal line 212 of the VCC level. As a result, the output voltages 504 of the outputs Y3, Y7, . . . $Y_{4M+3}$ further increase to the VCC level from the GND level (0 V). On the other hand, each of the outputs Y4, Y8, . . . $Y_{4M+4}$ of the short circuit 206 is electrically connected to the signal line 214 of the −VCC level. As a result, the output voltages 505 of the outputs Y4, Y8, . . . $Y_{4M+4}$ further decrease to the −VCC level from the GND level (0 V).

At the time t5, the GND short-circuit signal 1, the VCC short-circuit signal 1, and the VCC short-circuit signal 2 still remain in the LOW state. Accordingly, similarly to the case of the time t4, changes do not occur in the output voltages 502 of the outputs Y1, Y5, . . . $Y_{4M+1}$ and the output voltages 503 of the outputs Y2, Y6, . . . $Y_{4M+2}$ of the short circuit 206. Therefore, the output voltage 502 is maintained at the DP level (5.0 V), and the output voltage 506 is maintained at the DN level (−5.0 V).

At a time t6, the VCC short-circuit signal 3 becomes LOW from HIGH, and hence the VCC short-circuit SW 210 and the −VCC short-circuit SW 211 connected to the VCC short-circuit signal 3 are turned OFF. At this time, the output control signal 501 becomes HIGH from LOW, and hence the input SWs 208 are turned ON. Therefore, the inputs X1, X2, . . . Xm of the short circuit 206 and the outputs Y1, Y2, . . . Ym of the short circuit 206 are electrically connected. In other words, the inputs X1, X2, . . . Xm and the outputs Y1, Y2, . . . Ym are brought into the conduction state, respectively.

Here, the time t6 is in the G3 period, and hence, the DP level (5.0 V), which is output from the decoding circuit 205, is input to the inputs X3, X7, . . . $X_{4M+3}$ corresponding to the outputs Y3, Y7, . . . $Y_{4M+3}$ of the short circuit 206, among the inputs X1, X2, . . . Xm of the short circuit 206. As a result, the output voltages 504 of the outputs Y3, Y7, . . . $Y_{4M+3}$ of the short circuit 206 increase to the DP level (5.0 V) from the VCC level. Similarly, the DN level (−5.0 V), which is output from the decoding circuit 205, is input to the inputs X4, X8, . . . $X_{4M+4}$ corresponding to the outputs Y4, Y8, . . . $Y_{4M+4}$ of the short circuit 206, among the inputs X1, X2, . . . Xm of the short circuit 206. Accordingly, the output voltages 503 of the outputs Y4, Y8, . . . $Y_{4M+4}$ of the short circuit 206 decrease from the −VCC level to the DN level (−5.0 V).

At the time t6, the GND short-circuit signal 1, the VCC short-circuit signal 1, and the VCC short-circuit signal 2 still remain in the LOW state. Accordingly, similarly to the case of the time t4, changes do not occur in the output voltages 502 of the outputs Y1, Y5, . . . $Y_{4M+1}$ and the output voltages 503 of the outputs Y2, Y6, . . . $Y_{4M+2}$ of the short circuit 206. Therefore, the output voltage 502 is maintained at the DP level (5.0 V) and the output voltage 503 is maintained at the DN level (−5.0 V).

As a result, as illustrated in FIG. 4, the polarities of the pixels 402 in the G3 line change to "+−+−+−+− . . . " from the left side of FIG. 4 in the horizontal direction of the panel.

At a time t7, the polarity inversion does not occur, and hence changes do not occur in the output voltages 502 of the outputs Y1, Y5, . . . $Y_{4M+1}$ and the output voltages 504 of the outputs Y3, Y7, . . . $Y_{4M+3}$ of the short circuit 206. Therefore, the output voltage 502 and the output voltage 504 are maintained at the DP level (5.0 V), which is the output voltage of the decoding circuit 205. Similarly, changes do not occur in the output voltages 503 of the outputs Y2, Y6, . . . $Y_{4M+2}$ and the output voltages 505 of the outputs Y4, Y8, . . . $Y_{4M+4}$ of the short circuit 206. Therefore, the output voltage 503 and the output voltage 504 are maintained at the DN level (−5.0 V), which is the output voltage of the decoding circuit 205.

As a result, as illustrated in FIG. 4, the pixels 402 in the G4 line maintain polarities similar to those in the G3 line, which are "+−+−+−+− . . . " from the left side of FIG. 4 in the horizontal direction of the panel.

At a time t8, the output control signal 501 becomes LOW from HIGH, and hence the input SWs 208 are turned OFF. Therefore, each conduction state between the inputs X1, X2, . . . Xm and the outputs Y1, Y2, . . . Ym is turned OFF. At this time, the GND short-circuit signal 1 becomes HIGH from LOW, and hence the ground short-circuit SW 209 connected to the GND short-circuit signal 1 is turned ON. As a result, each of the outputs Y1, Y5, . . . $Y_{4M+1}$ of the short circuit 206 is electrically connected to the signal line 213 of the GND level (0 V). As a result, the output voltages 502 of the outputs Y1, Y5, . . . $Y_{4M+1}$ decrease to the GND level (0 V) from the DP level (5.0 V). Similarly, each of the outputs Y2, Y6, . . . $Y_{4M+2}$ of the short circuit 206 is electrically connected to the signal line 213 of the GND level (0 V). As a result, the output voltages 503 of the outputs Y2, Y6, . . . $Y_{4M+2}$ increase to the GND level (0 V) from the DN level (−5.0 V).

At this time, the GND short-circuit signal 2, the VCC short-circuit signal 3, and the VCC short-circuit signal 4 remain in the LOW state. Therefore, the ground short-circuit SW 209 connected to the GND short-circuit signal 2, and the VCC short-circuit SW 210 and the −VCC short-circuit SW 211 connected to the VCC short-circuit signal 3 or the VCC short-circuit signal 4 remain in the OFF state. As a result, changes do not occur in output voltages 504 of the outputs Y3, Y7, . . . $Y_{4M+3}$ and output voltages 505 of the outputs Y4, Y8, . . . $Y_{4M+4}$. Therefore, the output voltage 504 is maintained at the DP level (5.0 V) and the output voltage 505 is maintained at the DN level (−5.0 V).

At a time t9, the output control signal 501 remains in the LOW state, and hence each conduction state between the inputs X1, X2, . . . Xm and the outputs Y1, Y2, . . . Ym is maintained in the OFF state. The GND short-circuit signal 1 becomes LOW from HIGH, and hence the ground short-circuit SW 209 connected to the GND short-circuit signal 1 is turned OFF. On the other hand, the VCC short-circuit signal 2 becomes HIGH from LOW. Therefore, the −VCC short-circuit SW 211 connected to the VCC short-circuit signal 2, that is, the −VCC short-circuit SW 211 connected to each output Y1, Y5, . . . $Y_{4M+1}$, and the VCC short-circuit SW 210 connected to the VCC short-circuit signal 1, that is, the VCC short-circuit SW 210 connected to the each output Y2, Y6, . . . $Y_{4M+2}$ are turned ON.

Accordingly, each of the outputs Y1, Y5, . . . $Y_{4M+1}$ of the short circuit 206 is electrically connected to the signal line 214 of the −VCC level. As a result, the output voltages 502 of the outputs Y1, Y5, . . . $Y_{4M+1}$ further decrease to the −VCC level from the GND level (0 V). On the other hand, each of the outputs Y2, Y6, . . . $Y_{4M+2}$ of the short circuit 206 is electrically connected to the signal line 212 of the VCC level. As a result, the output voltages 503 of the outputs Y2, Y6, . . . $Y_{4M+2}$ further increase to the VCC level from the GND level (0 V).

At the time t9, the GND short-circuit signal 2, the VCC short-circuit signal 3, and the VCC short-circuit signal 4 still remain in the LOW state. Accordingly, similarly to the case of the time t0, changes do not occur in the output voltages 504 of the outputs Y3, Y7, . . . $Y_{4M+3}$ and the output voltages 505 of the outputs Y4, Y8, . . . $Y_{4M+4}$ of the short circuit 206. Therefore, the output voltage 504 is maintained at the DP level (5.0 V) and the output voltage 505 is maintained at the DN level (−5.0 V).

At a time t10, the VCC short-circuit signal 2 becomes LOW from HIGH, and hence the VCC short-circuit SW 210 and the −VCC short-circuit SW 211 connected to the VCC short-circuit signal 2 are turned OFF. At this time, the output control signal 501 becomes HIGH from LOW, and hence the input SWs 208 are turned ON. Therefore, the inputs X1, X2, . . . Xm and the outputs Y1, Y2, . . . Ym are brought into the conduction state, respectively.

Here, the time t10 is in the G5 period, and hence, the DN level (−5.0 V), which is output from the decoding circuit 205, is input to the inputs X1, X5, . . . $X_{4M+1}$ corresponding to the outputs Y1, Y5, . . . $Y_{4M+1}$ of the short circuit 206, among the inputs X1, X2, . . . Xm of the short circuit 206. As a result, the output voltages 502 of the outputs Y1, Y5, . . . $Y_{4M+1}$ of the short circuit 206 decrease to the DN level (−5.0 V) from the −VCC level. Similarly, the DP level (5.0 V), which is output from the decoding circuit 205, is input to the inputs X2, X6, . . . $X_{4M+2}$ corresponding to the outputs Y2, Y6, . . . $Y_{4M+2}$ of the short circuit 206, among the inputs X1, X2, Xm of the short circuit 206. Accordingly, the output voltages 503 of the outputs Y2, Y6, . . . $Y_{4M+2}$ of the short circuit 206 increase to the DP level (5.0 V) from the VCC level.

At the time t10, the GND short-circuit signal 2, the VCC short-circuit signal 3, and the VCC short-circuit signal 4 still remain in the LOW state. Accordingly, similarly to the case of the time t8, changes do not occur in the output voltages 504 of the outputs Y3, Y7, . . . $Y_{4M+3}$ and the output voltages 505 of the outputs Y4, Y8, . . . $Y_{4M+4}$ of the short circuit 206. Therefore, the output voltage 504 is maintained at the DP level (5.0 V), and the output voltage 505 is maintained at the DN level (−5.0 V).

As a result, as illustrated in FIG. 4, the polarities of the pixels 402 in the G5 line change to "−++−−++− . . . " from the left side of FIG. 4 in the horizontal direction of the panel.

At a time t11, the polarity inversion does not occur, and hence changes do not occur in the output voltages 503 of the outputs Y2, Y6, . . . $Y_{4M+2}$ and the output voltages 504 of the outputs Y3, Y7, . . . $Y_{4M+3}$ of the short circuit 206. Therefore, the output voltage 503 and the output voltage 504 are maintained at the DP level (5.0 V), which is the output voltage of the decoding circuit 205. Similarly, changes do not occur in the output voltages 502 of the outputs Y1, Y5, . . . $Y_{4M+1}$ and the output voltages 505 of the outputs Y4, Y8, . . . $Y_{4M+4}$ of the short circuit 206. Therefore, the output voltage 502 and the output voltage 505 are maintained at the DN level (−5.0 V), which is the output voltage of the decoding circuit 205.

As a result, as illustrated in FIG. 4, the polarities of the pixels 402 in the G6 line maintain polarities similar to those in the G5 line, which are "−++−−++− . . . " from the left side of FIG. 4 in the horizontal direction of the panel.

At a subsequent time t12, the output control signal 501 becomes LOW from HIGH, and hence the input SWs 208 are turned OFF. Therefore, each conduction state between the inputs X1, X2, . . . Xm and the outputs Y1, Y2, . . . Ym is turned OFF. At this time, the GND short-circuit signal 2 becomes HIGH from LOW, and hence the ground short-circuit SW 209 connected to the GND short-circuit signal 2 is turned ON. As a result, each of the outputs Y3, Y7, . . . $Y_{4M+3}$ of the short circuit 206 is electrically connected to the signal line 213 of the GND level (0 V). As a result, the output voltages 504 of the outputs Y3, Y7, . . . $Y_{4M+3}$ decrease to the GND level (0 V) from the DP level (5.0 V). Similarly, each of the outputs Y4, Y8, . . . $Y_{4M+4}$ of the short circuit 206 is electrically connected to the signal line 213 of the GND level (0 V). As a result, the output voltages 505 of the outputs Y4, Y8, . . . $Y_{4M+4}$ increase to the GND level (0 V) from the DN level (−5.0 V).

At this time, the GND short-circuit signal 1, the VCC short-circuit signal 1, and the VCC short-circuit signal 2 remain in the LOW state. Therefore, the ground short-circuit SW 209 connected to the GND short-circuit signal 1, and the VCC short-circuit SW 210 and the −VCC short-circuit SW 211 connected to the VCC short-circuit signal 1 or the VCC short-circuit signal 2 remain in the OFF state. As a result, changes do not occur in output voltages 502 of the outputs Y1, Y5, . . . $Y_{4M+1}$ and output voltages 503 of the outputs Y2, Y6, . . . $Y_{4M+2}$. Therefore, the output voltage 502 is maintained at the DN level (−5.0 V), and the output voltage 503 is maintained at the DP level (5.0 V).

At a time t13, the output control signal 501 remains in the LOW state, and hence each conduction state between the inputs X1, X2, . . . Xm and the outputs Y1, Y2, . . . Ym is maintained in the OFF state. The GND short-circuit signal 2 becomes LOW from HIGH, and hence the ground short-circuit SW 209 connected to the GND short-circuit signal 2 is turned OFF. On the other hand, the VCC short-circuit signal 4 becomes HIGH from LOW. Therefore, the −VCC short-circuit SW 211 connected to the VCC short-circuit signal 4, that is, the −VCC short-circuit SW 211 connected to each output Y3, Y7, . . . $Y_{4M+3}$, and the VCC short-circuit SW 210 connected to the VCC short-circuit signal 3, that is, the VCC short-circuit SW 210 connected to the each output Y4, Y8, . . . $Y_{4M+4}$ are turned ON.

Accordingly, each of the outputs Y3, Y7, . . . $Y_{4M+3}$ of the short circuit 206 is electrically connected to a signal line 214 of the −VCC level. As a result, the output voltages 504 of the outputs Y3, Y7, . . . $Y_{4M+3}$ further decrease to the −VCC level from the GND level (0 V). On the other hand, each of the outputs Y4, Y8, . . . $Y_{4M+4}$ of the short circuit 206 is electrically connected to a signal line 212 of the VCC level. As a result, the output voltages 505 of the outputs Y4, Y8, . . . $Y_{4M+4}$ further increase to the VCC level from the GND level (0 V).

At the time t13, the GND short-circuit signal 1, the VCC short-circuit signal 1, and the VCC short-circuit signal 2 still remain in the LOW state. Accordingly, similarly to the case of the time t12, changes do not occur in the output voltages 502 of the outputs Y1, Y5, . . . $Y_{4M+1}$ and the output voltages 503 of the outputs Y2, Y6, . . . $Y_{4M+2}$ of the short circuit 206. Therefore, the output voltage 502 is maintained at the DN level (−5.0 V), and the output voltage 506 is maintained at the DP level (5.0 V).

At a time t14, the VCC short-circuit signal 4 becomes LOW from HIGH, and hence the VCC short-circuit SW 210 and the −VCC short-circuit SW 211 connected to the VCC short-circuit signal 4 are turned OFF. At this time, the output control signal 501 becomes HIGH from LOW, and hence the input SWs 208 are turned ON. Therefore, the inputs X1, X2, . . . Xm and the outputs Y1, Y2, . . . Ym are brought into the conduction state, respectively.

Here, the time t14 is in the G7 period, and hence, the DN level (−5.0 V), which is output from the decoding circuit 205, is input to the inputs X3, X7, . . . $X_{4M+3}$ corresponding to the outputs Y3, Y7, . . . $Y_{4M+3}$ of the short circuit 206, among the inputs X1, X2, . . . Xm of the short circuit 206. As a result, the output voltages 504 of the outputs Y3, Y7, . . . $Y_{4M+3}$ of the short circuit 206 decrease to the DN level (−5.0 V) from the −VCC level. Similarly, the DP level (5.0 V), which is output from the decoding circuit 205, is input to the inputs X4, X8, . . . $X_{4M+4}$ corresponding to the outputs Y4, Y8, . . . $Y_{4M+4}$ of the short circuit 206, among the inputs X1, X2, . . . Xm of the short circuit 206. Accordingly, the output voltages 505 of the outputs Y4, Y8, . . . $Y_{4M+4}$ of the short circuit 206 increase to the DP level (5.0 V) from the VCC level.

At the time t14, the GND short-circuit signal 1, the VCC short-circuit signal 1, and the VCC short-circuit signal 2 still remain in the LOW state. Accordingly, similarly to the case of the time t12, changes do not occur in the output voltages 502 of the outputs Y1, Y5, . . . $Y_{4M+1}$ and the output voltages 503 of the outputs Y2, Y6, . . . $Y_{4M+2}$ of the short circuit 206. Therefore, the output voltage 502 is maintained at the DN level (−5.0 V), and the output voltage 503 is maintained at the DP level (5.0 V).

As a result, as illustrated in FIG. 4, the polarities of the pixels 402 in the G7 line change to "−+−+−+−+ . . . " from the left side of FIG. 4 in the horizontal direction of the panel.

After the time t14, the operation during the time t0 to the time t14 described above are shifted by one line every one frame. In this manner, effects described later may be obtained.

As described above, in the short circuit 206 of the first embodiment, the short-circuit operation may be performed separately for the outputs $Y_{4M+1}$ and $Y_{4M+2}$ and the outputs $Y_{4M+3}$ and $Y_{4M+4}$. Therefore, even when the output voltage is changed so as to change the polarities of one of the outputs $Y_{4M+1}$ and $Y_{4M+2}$ and the outputs $Y_{4M+3}$ and $Y_{4M+4}$, it is unnecessary to change the other output voltage, and hence the liquid crystal display device may be reduced in power consumption. In other words, it is possible to realize precharge/short-circuit drive, which achieves a large power consumption reduction effect.

[Details of Voltage Polarity]

FIGS. 6A to 6H are diagrams illustrating voltage polarity distributions on successive frames of the liquid crystal display device according to the first embodiment of the present invention. Hereinafter, with reference to FIGS. 6A to 6H, the voltage polarity distributions on the successive frames in polarity inversion line dispersion type 1×4 dot inversion drive is described.

As illustrated in FIGS. 6A to 6H, the polarity inversion lines 401 of the pair of the outputs $Y_{4M+1}$ and $Y_{4M+2}$ and the pair of the outputs $Y_{4M+3}$ and $Y_{4M+4}$ are shifted by 2 lines. Further, from 8n+1 frame (where n is an integer equal to or larger than 0) to 8n+8 frame, the polarity inversion lines 401 of the pair of the outputs $Y_{4M+1}$ and $Y_{4M+2}$ and the pair of the outputs $Y_{4M+3}$ and $Y_{4M+4}$ are shifted by 1 line in a column direction. Further, when paying attention to a single pixel, there is provided a pattern in which the polarity of the pixel is positive in 4 successive frames and the polarity thereof is negative in the next 4 successive frames. The same applies to all the pixels.

For example, the sub-pixel in the first line and the first column (position at the first line of the output Y1) of FIGS. 6A to 6H has a negative polarity in the 4 successive frames from 8n+2 to 8n+5, and has a positive polarity in the next 4 successive frames from 8n+6 to 8n+8 and 8n+1. The reason for employing this pattern is as follows. That is, the polarity inversion cycle and the polarity change pattern in a frame direction are required to be the same in all pixels in order to suppress another image quality deterioration component (flicker), as described later.

Specifically, in 8n+1 frame, in the first line, the output $Y_{4M+1}$ is a positive voltage output (output $Y_{4M+2}$ is a negative voltage output), and the output $Y_{4M+3}$ is a negative voltage output (output $Y_{4M+4}$ is a positive voltage output). Further, a position to serve as the polarity inversion line 401 in each column of the pair of the outputs $Y_{4M+1}$ and $Y_{4M+2}$ is set to start from the first line, and a position to serve as the polarity inversion line 401 in each column of the pair of the outputs $Y_{4M+3}$ and $Y_{4M+4}$ is set to start from the third line. Note that, the polarity inversion cycle is 4 line cycle in all the columns in all the frames.

In 8n+2 frame, in the first line, the output $Y_{4M+1}$ is a negative voltage output (output $Y_{4M+2}$ is a positive voltage output), and the output $Y_{4M+3}$ is a negative voltage output (output $Y_{4M+4}$ is a positive voltage output). Further, the position to serve as the polarity inversion line 401 in each column of the pair of the outputs $Y_{4M+1}$ and $Y_{4M+2}$ is set to start from the second line, and the position to serve as the polarity inversion line 401 in each column of the pair of the outputs $Y_{4M+3}$ and $Y_{4M+4}$ is set to start from the fourth line.

In 8n+3 frame, in the first line, the output $Y_{4M+1}$ is a negative voltage output (output $Y_{4M+2}$ is a positive voltage output), and the output $Y_{4M+3}$ is a negative voltage output (output $Y_{4M+4}$ is a positive voltage output). Further, the position to serve as the polarity inversion line 401 in each column of the pair of the outputs $Y_{4M+1}$ and $Y_{4M+2}$ is set to start from the third line, and the position to serve as the polarity inversion line 401 in each column of the pair of the outputs $Y_{4M+3}$ and $Y_{4M+4}$ is set to start from the first line.

In 8n+4 frame, in the first line, the output $Y_{4M+1}$ is a negative voltage output (output $Y_{4M+2}$ is a positive voltage output), and the output $Y_{4M+3}$ is a positive voltage output (output $Y_{4M+4}$ is a negative voltage output). Further, the position to serve as the polarity inversion line 401 in each column of the pair of the outputs $Y_{4M+1}$ and $Y_{4M+2}$ is set to start from the fourth line, and the position to serve as the polarity inversion line 401 in each column of the pair of the outputs $Y_{4M+3}$ and $Y_{4M+4}$ is set to start from the second line.

In 8n+5 frame, in the first line, the output $Y_{4M+1}$ is a negative voltage output (output $Y_{4M+2}$ is a positive voltage output), and the output $Y_{4M+3}$ is a positive voltage output (output $Y_{4M+4}$ is a negative voltage output). Further, the position to serve as the polarity inversion line 401 in each column of the pair of the outputs $Y_{4M+1}$ and $Y_{4M+2}$ is set to start from the first line, and the position to serve as the polarity inversion line 401 in each column of the pair of the outputs $Y_{4M+3}$ and $Y_{4M+4}$ is set to start from the third line.

In 8n+6 frame, in the first line, the output $Y_{4M+1}$ is a positive voltage output (output $Y_{4M+2}$ is a negative voltage output), and the output $Y_{4M+3}$ is a positive voltage output (output $Y_{4M+4}$ is a negative voltage output). Further, the position to serve as the polarity inversion line 401 in each column of the pair of the outputs $Y_{4M+1}$ and $Y_{4M+2}$ is set to start from the second line, and the position to serve as the polarity inversion line 401 in each column of the pair of the outputs $Y_{4M+3}$ and $Y_{4M+4}$ is set to start from the fourth line.

In 8n+7 frame, in the first line, the output $Y_{4M+1}$ is a positive voltage output (output $Y_{4M+2}$ is a negative voltage output), and the output $Y_{4M+3}$ is a positive voltage output (output $Y_{4M+4}$ is a negative voltage output). Further, the position to serve as the polarity inversion line 401 in each column of the pair of the outputs $Y_{4M+1}$ and $Y_{4M+2}$ is set to start from the third line, and the position to serve as the polarity inversion line 401 in each column of the pair of the outputs $Y_{4M+3}$ and $Y_{4M+4}$ is set to start from the first line.

In 8n+8 frame, in the first line, the output $Y_{4M+1}$ is a positive voltage output (output $Y_{4M+2}$ is a negative voltage output), and the output $Y_{4M+3}$ is a negative voltage output (output $Y_{4M+4}$ is a positive voltage output). Further, the position to serve as the polarity inversion line 401 in each column of the pair of the outputs $Y_{4M+1}$ and $Y_{4M+2}$ is set to start from the fourth line, and the position to serve as the polarity inversion line 401 in each column of the pair of the outputs $Y_{4M+3}$ and $Y_{4M+4}$ is set to start from the second line.

As described above, when the polarity inversion line dispersion type 1×4 dot inversion drive of the first embodiment is performed, control repeating the frames 8n+1 to 8n+8 described above in the stated order is performed.

[Description of Effects]

In the liquid crystal display device with this configuration, the polarity inversion line dispersion type 1×N (N≥2) dot inversion drive is performed. At this time, the short-circuit drive may be performed only when the polarities are inverted, and hence the liquid crystal display device may achieve low power consumption. That is, there may be realized precharge/short-circuit drive which is capable of achieving a large power consumption reduction effect.

Further, in the liquid crystal display device, a dispersion pattern of the polarity inversion line is used, and hence high frequency components change the polarity inversion lines 401 of the liquid crystal display device in terms of space and time, which prevents the appearance of the polarity inversion lines 401, to thereby avoid deterioration of the display quality. This is because, in the case of the 1×N (where N=2, 4, and 8) dot inversion which performs polarity inversion every N lines, the dispersion pattern of the polarity inversion lines 401 has a configuration that the polarity inversion lines 401 of the outputs $Y_{4M+1}$ and $Y_{4M+2}$ and the outputs $Y_{4M+3}$ and $Y_{4M+4}$ are shifted by N/2 lines. With such a dispersion pattern, influence with respect to the image quality at the polarity inversion line positions is reduced.

Hereinafter, how the influence with respect to the image quality is reduced is described in detail. An objective evaluation is carried out by the inventor, and the results show that, in the case of the polarity inversion line dispersion type 1×N dot inversion in which the polarity inversion lines are spatially dispersed in the liquid crystal panel, amount of the image quality deterioration differs according to the dispersion pattern, and further, the dispersion pattern has small image quality deterioration when the pattern has the polarity inversion lines of the outputs $Y_{4M+1}$ and $Y_{4M+2}$ and the outputs $Y_{4M+3}$ and $Y_{4M+4}$ shifted by N/2, as illustrated in FIGS. 6A to 6H.

Here, the objective evaluation is described. In the objective evaluation, frequency components at positions of the polarity inversion lines in the liquid crystal panel are analyzed in terms of space and time, and are quantified using a predetermined equation. The equation is expressed as Expression 1 below.

[Expression 1]

$$E=\Sigma\{\alpha\times F(u,v,w)\}+E_0 \quad (1)$$

Note that, in Expression 1, E represents an objective evaluation value, α represents a weight coefficient of each frequency component, F(u,v,w) represents the frequency component (result of three-dimensional fourier transform), and $E_0$ represents an offset value.

Here, the frequency component F(u,v,w) may satisfy Expression 2 below.

[Expression 2]

$$F(u, v, w) = \sum_{t=0}^{15} e^{-j\frac{2\pi}{16}wt} \sum_{y=0}^{15} e^{-j\frac{2\pi}{16}vy} \sum_{x=0}^{15} e^{-j\frac{2\pi}{16}ux} n(x, y, t) \quad (2)$$

Note that, in Expression 2, n(x,y,t) represents a position of the polarity inversion line in 16 horizontal pixels, 16 vertical pixels, and 16 frames. When the position at the x-th horizontal pixel (X=0 to 15), the y-th vertical pixel (y=0 to 15), and the t-th frame (t=0 to 15) is the polarity inversion line, n(x,y,t) is 1, and when the position is not the polarity inversion line, n(x,y,t) is zero (0).

Here, u (u=0 to 15) represents a frequency component of x component, v (v=0 to 15) represents a frequency component of y component, and w (w=0 to 15) represents a frequency component of t component. Further, when u, v, and w are 0, the frequency component is a DC component, and as the number increases, the frequency component is higher in frequency.

As understood from the above, the frequency component F(u,v,w) includes 4096 frequency components. The objective evaluation value E is calculated from the 4096 frequency components F(u,v,w), 4096 weight coefficients α, and one offset value. Here, with respect to the coefficient α and the offset value $E_0$ in Expression 1, the coefficients are determined by a least squares method so that an error between the objective evaluation value and an evaluation result obtained by an actual device becomes minimum in a plurality of evaluation patterns.

According to the expressions described above, the objective evaluation value is calculated from the frequency component, the weight coefficient of each frequency component, and the offset value. It has been confirmed that this objective evaluation value has a high correlation with the result of subjective evaluation obtained by the actual device.

Here, for example, in the case of 1×4 dot inversion, the dispersion patterns which may be obtained in 8 horizontal pixels, 8 vertical pixels, and 8 frames evaluated by Expression 1 are verified. Here, a pattern in the frame direction assumes a single pattern similarly to the pattern of FIGS. 6A to 6H (note that, also similarly to patterns of second and third embodiments to be described later). The reason for employing this pattern is as follows. That is, the polarity inversion cycle in the frame direction is required to be the same in all pixels in order to suppress the another image quality deterioration component (flicker).

Further, it makes a condition that there are 2 polarity inversion lines in the 8 vertical pixels and the polarity inversion lines are provided every 4 lines. For example, when the first vertical pixel is the polarity inversion line, the fifth vertical pixel is also required to be the polarity inversion line. In addition, it is assumed that the same luminance variation is generated when the polarity inversion line is converted from positive to negative and when the polarity inversion line is converted from negative to positive. Therefore, the dispersion pattern when 1×4 dot inversion drive is performed may include 8 pixels/2=4 patterns in the vertical direction. Further, in the horizontal direction, 2 pixels adjacent to each other have the same polarity inversion line, and the polarities thereof are opposite to each other.

For example, in a case where the first and second horizontal pixels perform polarity inversion at the same time, and the first horizontal pixel is positive, the second horizontal pixel is negative. Therefore, there may be conceived 8 pixels/2=4 patterns in the horizontal direction. Therefore, 4×4=16 dispersion patterns in total are evaluated. The results show that the dispersion pattern illustrated in FIGS. 6A to 6H (note that, the dispersion pattern also includes patterns of second and third embodiments to be described later) has a best result. This is because the polarity inversion lines in this dispersion pattern are highest in spatial frequency.

Here, for example, in the case of 1×4 dot inversion, the dispersion patterns which may be obtained in 8 horizontal pixels, 8 vertical pixels, and 8 frames evaluated by Expression 1 are verified. Here, a pattern in the frame direction assumes a single pattern similarly to the pattern of FIGS. 6A to 6H (note that, also similarly to patterns of second and third embodiments to be described later). The reason for employing this pattern is as follows. That is, the polarity inversion cycle in the frame direction is required to be the same in all pixels in order to suppress the another image quality deterioration component (flicker).

Further, it makes a condition that there are 2 polarity inversion lines in the 8 vertical pixels and the polarity inversion lines are provided every 4 lines. For example, when the first vertical pixel is the polarity inversion line, the fifth vertical pixel is also required to be the polarity inversion line. In addition, it is assumed that the same luminance variation is generated when the polarity inversion line is converted from positive to negative and when the polarity inversion line is converted from negative to positive. Therefore, the dispersion pattern when 1×4 dot inversion drive is performed may include 8 pixels/2=4 patterns in the vertical direction. Further, in the horizontal direction, 2 pixels adjacent to each other have the same polarity inversion line, and the polarities thereof are opposite to each other.

For example, in a case where the first and second horizontal pixels perform polarity inversion at the same time, and the first horizontal pixel is positive, the second horizontal pixel is negative. Therefore, there may be conceived 8 pixels/2=4 patterns in the horizontal direction. Therefore, 4×4=16 dispersion patterns in total are evaluated. The results show that the dispersion pattern illustrated in FIGS. 6A to 6H (note that, the dispersion pattern also includes patterns of second and third embodiments to be described later) has a best result. This is because the polarity inversion lines in this dispersion pattern are highest in spatial frequency.

As described above, the liquid crystal display device of the first embodiment performs polarity inversion line dispersion type 1×N dot inversion drive in which the polarity inversion lines are dispersed in the panel spatially when 1×N (N≥2) dot inversion drive is performed. In particular, the liquid crystal display device has a configuration that, among the number of the outputs 4M+4 of the data driver, the outputs $Y_{4M+1}$ and $Y_{4M+2}$ in a pair have the same polarity inversion line, and the outputs $Y_{4M+3}$ and $Y_{4M+4}$ in a pair have the same polarity inversion line. Further, the liquid crystal display device has a configuration that the polarity inversion line of the pair of the outputs $Y_{4M+1}$ and $Y_{4M+2}$ and the polarity inversion line of the pair of the outputs $Y_{4M+3}$ and $Y_{4M+4}$ are shifted by N/2 lines. Further, the liquid crystal display device employs the pre-charge/short-circuit drive. Therefore, the liquid crystal display device is capable of providing high display quality, that is, high image quality, while achieving a large power consumption reduction effect.

Those effects described above may be attained because, in the short circuit described above, the signal controlling the outputs $Y_{4M+1}$ and $Y_{4M+2}$ and the signal controlling the outputs $Y_{4M+3}$ and $Y_{4M+4}$ are provided separately.

With the features described above, it is possible to realize the short-circuit drive only at the line in which the polarities are inverted, and thus the effects as described above may be obtained.

Second Embodiment

FIGS. 7A to 7D are diagrams illustrating voltage polarity distributions on successive frames of a liquid crystal display device according to a second embodiment of the present invention. Hereinafter, with reference to FIGS. 7A to 7D, the voltage polarity distributions on the successive frames when polarity inversion line dispersion type 1×2 dot inversion drive is performed is described.

The 1×2 dot inversion drive signal lines in the short circuit may be controlled by a method similar to the control method of the first embodiment. That is, the output control signal turns OFF the input SWs 208 for every 1 horizontal cycle, that is, in the T1 period and in the T2 period in G1, G2, G3, . . . of FIG. 5.

Further, the GND short-circuit signal 1 becomes HIGH for every 2 horizontal cycles (T1 period in G1, G3, G5, . . . ), the VCC short-circuit signal 1 becomes HIGH for every 4 horizontal cycles (T2 period in G1, G5, G9, . . . ), and the VCC short-circuit signal 2 becomes HIGH for every 4 horizontal cycles (T2 period in G3, G7, G11, . . . ).

Further, the GND short-circuit signal 2 becomes HIGH for every 2 horizontal cycles (T1 period in G2, G4, G6, . . . ), the VCC short-circuit signal 3 becomes HIGH for every 4 horizontal cycles (T2 period in G2, G6, G10, . . . ), and the VCC short-circuit signal 4 becomes HIGH for every 4 horizontal cycles (T2 period in G4, G8, G12, . . . ).

By changing the output timing of each signal as described above, the polarity inversion line dispersion type 1×2 dot inversion drive of the second embodiment may be realized using the short circuit described in the first embodiment.

As illustrated in FIGS. 7A to 7D, in the polarity inversion line dispersion type 1×2 dot inversion drive of the second embodiment, the polarity inversion lines of the pair of the outputs $Y_{4M+1}$ and $Y_{4M+2}$ and the pair of the outputs $Y_{4M+3}$ and $Y_{4M+4}$ are shifted by 1 line. Further, from 4n+1 frame to 4n+4 frame, the polarity inversion lines of the pair of the outputs $Y_{4M+1}$ and $Y_{4M+2}$ and the pair of the outputs $Y_{4M+3}$ and $Y_{4M+4}$ (M=0, 1, 2, . . . ) are shifted by 1 line in the column direction. For example, a sub-pixel in the first line and the first column (position at the first line of the output Y1) of FIGS. 7A to 7D has a negative polarity in the 2 successive frames from 4n+2 to 4n+3, and has a positive polarity in the next 2 successive frames from 4n+4 to 4n+1. This pattern is employed for suppressing the another image quality deterioration component (flicker) as described in the first embodiment.

Further, when paying attention to a single pixel, there is provided a pattern in which the polarity of the pixel is positive in 2 successive frames and the polarity thereof is negative in the next 2 successive frames. The same applies to all the pixels.

As described above, also in the liquid crystal display device according to the second embodiment, when the polarity inversion line dispersion type 1×N dot inversion drive in which the polarity inversion lines are dispersed in the panel spatially is performed, in particular, among the number of the outputs 4M+4 of the data driver, the outputs $Y_{4M+1}$ and $Y_{4M+2}$ in a pair have the same polarity inversion line, and the outputs $Y_{4M+3}$ and $Y_{4M+4}$ in a pair have the same polarity inversion line. Further, the polarity inversion line of the pair of the outputs $Y_{4M+1}$ and $Y_{4M+2}$ and the polarity inversion line of the pair of the outputs $Y_{4M+3}$ and $Y_{4M+4}$ are shifted by N/2 lines. Therefore, effects similar to those of the first embodiment may be obtained.

Third Embodiment

Figure 8A:
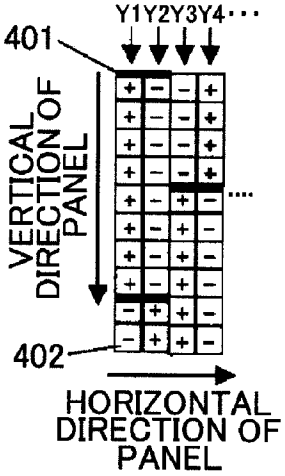
FIGS. 8A to 8P are diagrams illustrating voltage polarity distributions on successive frames in a liquid crystal display device according to a third embodiment of the present invention.
Figure 8B:
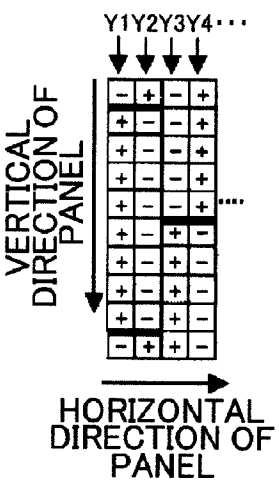
Figure 8C:
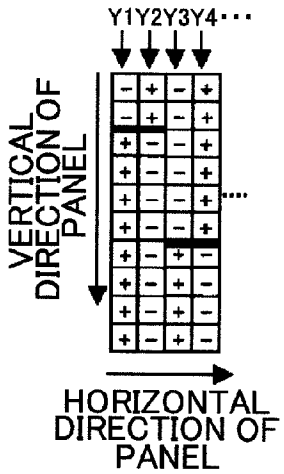
Figure 8D:
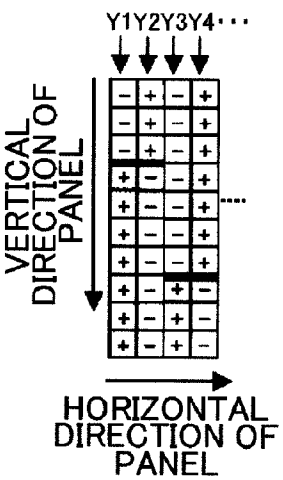
Figure 8E:
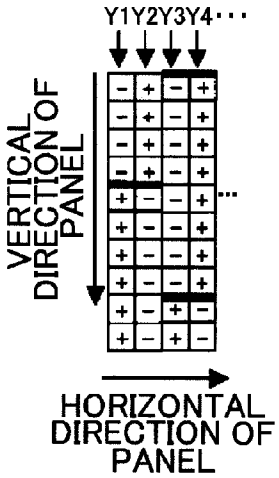
Figure 8F:
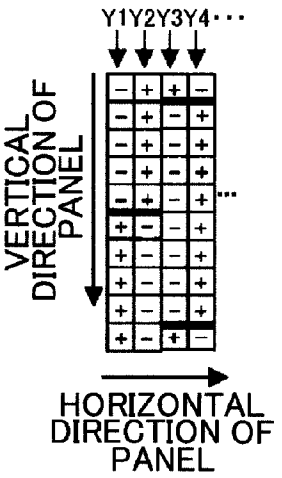
Figure 8G:
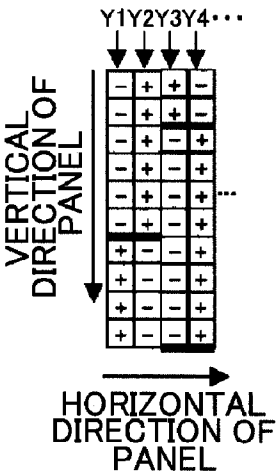
Figure 8H:
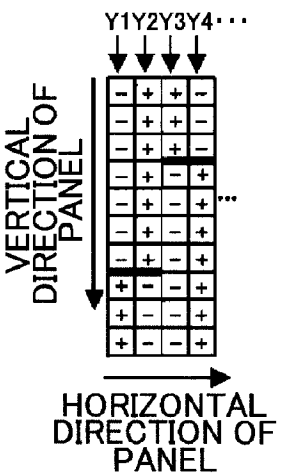
Figure 8I:
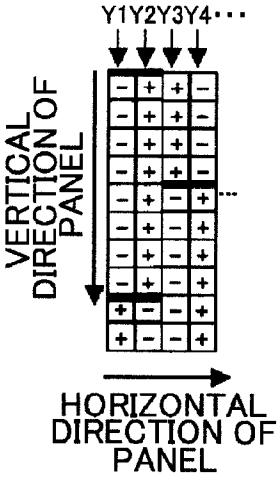
Figure 8J:
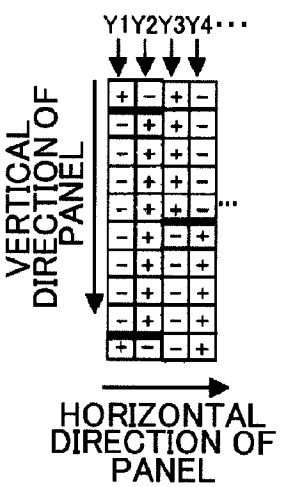
Figure 8K:
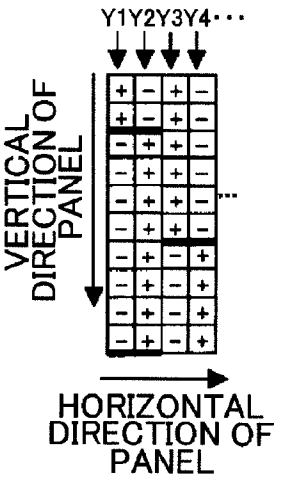
Figure 8L:
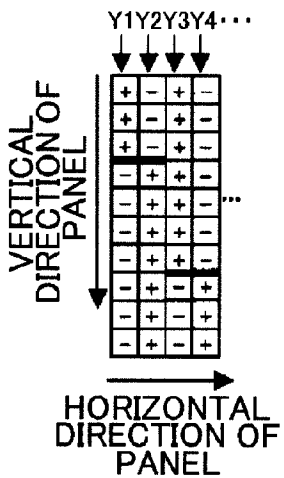
Figure 8M:
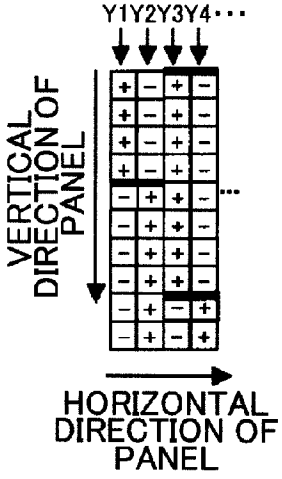
Figure 8N:
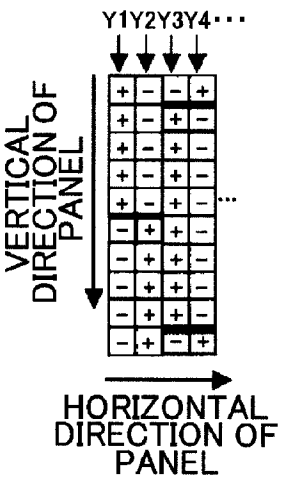
Figure 8O:
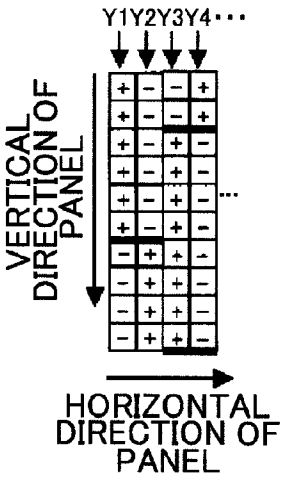
Figure 8P:
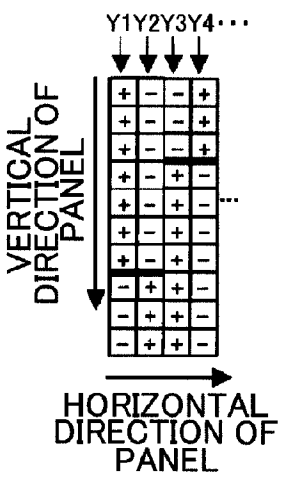

FIGS. 8A to 8P are diagrams illustrating voltage polarity distributions on successive frames of a liquid crystal display device according to a third embodiment of the present invention. Hereinafter, with reference to FIGS. 8A to 8P, the voltage polarity distributions on the successive frames when polarity inversion line dispersion type 1×8 dot inversion drive is performed is described.

The 1×8 dot inversion drive signal lines in the short circuit may be controlled by a method similar to the control method of the first embodiment. That is, the output control signal turns OFF the input SWs 208 for every 4 horizontal cycles, that is, in the T1 period and in the T2 period in G1, G5, G9, . . . .

Further, the GND short-circuit signal 1 becomes HIGH for every 8 horizontal cycles (T1 period in G1, G9, G17, . . . ), the VCC short-circuit signal 1 becomes HIGH for every 16 horizontal cycles (T2 period in G1, G17, G33, . . . ), and the VCC short-circuit signal 2 becomes HIGH for every 16 horizontal cycles (T2 period in G9, G25, G41, . . . ).

Further, the GND short-circuit signal 2 becomes HIGH for every 8 horizontal cycles (T1 period in G5, G13, G21, . . . ), the VCC short-circuit signal 3 becomes HIGH for every 16 horizontal cycles (T2 period in G5, G21, G37, . . . ), and the VCC short-circuit signal 4 becomes HIGH for every 16 horizontal cycles (T2 period in G13, G29, G45, . . . ).

By changing the output timing of each signal as described above, the polarity inversion line dispersion type 1×8 dot inversion drive of the third embodiment may be realized using the short circuit described in the third embodiment.

As illustrated in FIGS. 8A to 8P, in the polarity inversion line dispersion type 1×8 dot inversion drive of the third embodiment, the polarity inversion lines of the pair of the outputs $Y_{4M+1}$ and $Y_{4M+2}$ and the pair of the outputs $Y_{4M+3}$ and $Y_{4M+4}$ are shifted by 4 lines. Further, from 16n+1 frame to 16n+16 frame, the polarity inversion lines of the pair of the outputs $Y_{4M+1}$ and $Y_{4M+2}$ and the pair of the outputs $Y_{4M+3}$ and $Y_{4M+4}$ are shifted by 1 line in the column direction.

Further, when paying attention to a single pixel, there is provided a pattern in which the polarity of the pixel is positive in 8 successive frames and the polarity thereof is negative in the next 8 successive frames. The same applies to all the pixels. For example, a sub-pixel in the first line and the first column (position at the first line of the output Y1) of FIGS. 8A to 8P has a negative polarity in the 8 successive frames from 16n+2 to 16n+9 and has a positive polarity in the next 8 successive frames from 16n+10 to 16n+1. This pattern is employed for suppressing the another image quality deterioration component (flicker) as described in the first embodiment.

As described above, also in the liquid crystal display device according to the third embodiment, when the polarity inversion line dispersion type 1×N dot inversion drive in which the polarity inversion lines are dispersed in the panel spatially is performed, in particular, among the number of the outputs 4M+4 of the data driver, the outputs $Y_{4M+1}$ and $Y_{4M+2}$ in a pair have the same polarity inversion line, and the outputs $Y_{4M+3}$ and $Y_{4M+4}$ in a pair have the same polarity inversion line. Further, the polarity inversion line of the pair of the outputs $Y_{4M+1}$ and $Y_{4M+2}$ and the polarity inversion line of the pair of the outputs $Y_{4M+3}$ and $Y_{4M+4}$ are shifted by N/2 lines. Therefore, effects similar to those of the first embodiment may be obtained.

Fourth Embodiment

Figure 9:
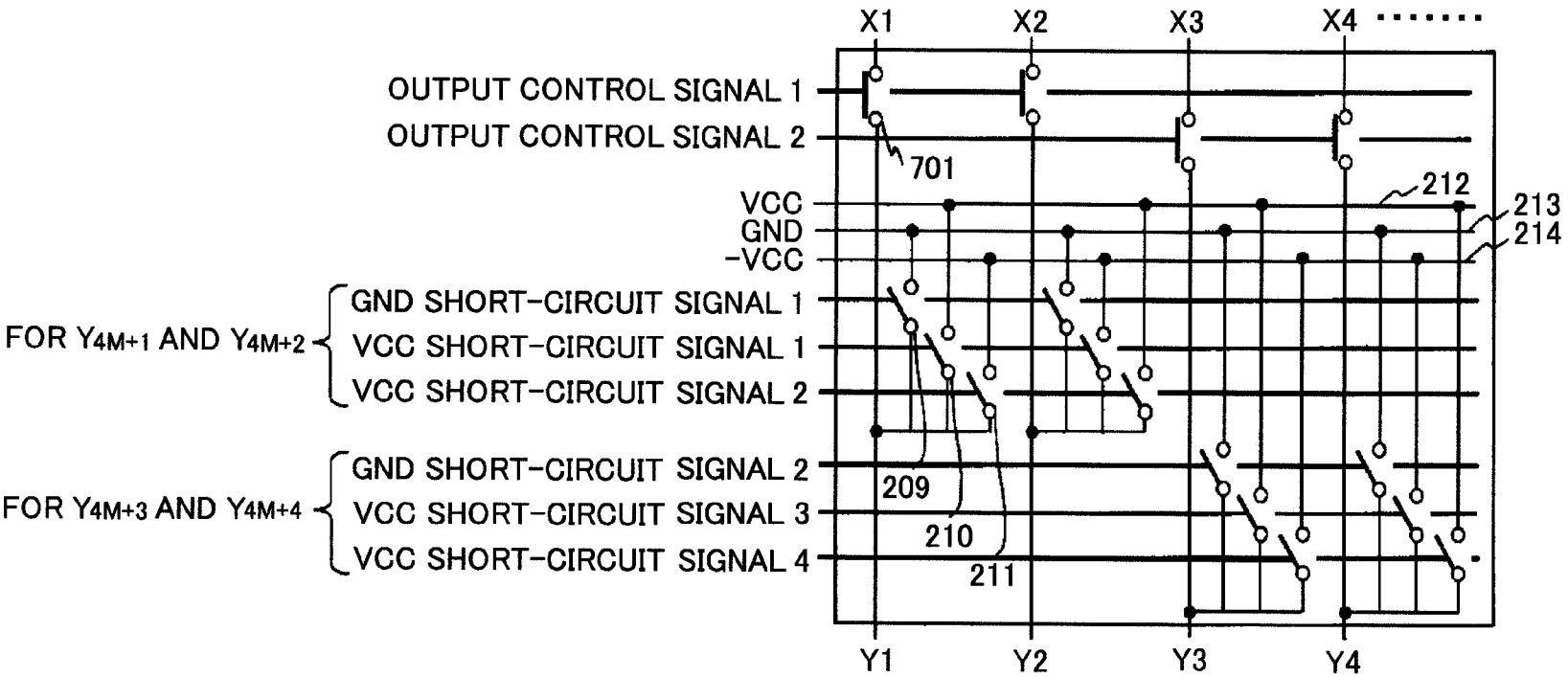
FIG. 9 is a diagram for describing an inner configuration of a short circuit of a liquid crystal display device according to a fourth embodiment of the present invention.

FIG. 9 is a diagram for describing an inner configuration of a short circuit of a liquid crystal display device according to a fourth embodiment of the present invention. Hereinafter, with reference to FIG. 9, the configuration of the short circuit of the fourth embodiment, which is a feature of the present invention, is described. Note that, the liquid crystal display device of the fourth embodiment is different from that of the first embodiment in that input SWs 701 connecting the inputs X1, X2, . . . Xm (where X is a natural number) to the outputs Y1, Y2, . . . Ym of the short circuit include an input SW 701 controlled by the output control signal 1 and an input SW 701 controlled by an output control signal 2. Other configurations are the same as those of the first embodiment. Therefore, in the following description, the input SWs 701 and the output control signals 1 and 2 controlling the input SWs 701 are described in detail.

As illustrated in FIG. 9, in the short circuit of the fourth embodiment, the input SW 701 is provided between the input Xm and the output Ym. The input SW 701 is used for turning OFF the conduction state between the input Xm and the output Ym when a short-circuit operation for the output Ym is performed as described later.

Between the input SW 701 and the output Ym, the ground short-circuit SW 209 for establishing a short circuit to the ground, the VCC short-circuit SW 210 for establishing a short circuit to the VCC voltage, and the −VCC short-circuit SW 211 for establishing a short circuit to the −VCC voltage are connected to each output Ym. MOSFET may be used as the SW group in view of, for example, low power consumption. The SW group is configured for each output, and the control lines of the SWs are different in each output.

In addition, in the fourth embodiment, the input SWs 701 are also separately controlled for the outputs having the same polarity inversion line (for the pair of the outputs $Y_{4M+1}$ and $Y_{4M+2}$ and for the pair of the outputs $Y_{4M+3}$ and $Y_{4M+4}$). Specifically, in the fourth embodiment, the pair of the outputs $Y_{4M+1}$ and $Y_{4M+2}$ (Y1 and Y2, Y5 and Y6, Y9 and Y10, . . . ) are controlled by using the GND short-circuit signal 1, the VCC short-circuit signal 1, the VCC short-circuit signal 2, and the output control signal 1. On the other hand, the pair of the outputs $Y_{4M+3}$ and $Y_{4M+4}$ (Y3 and Y4, Y7 and Y8, Y11 and Y12, . . . ) are controlled by using the GND short-circuit signal 2, the VCC short-circuit signal 3, the VCC short-circuit signal 4, and the output control signal 2.

Here, connection of the control lines and the SW group is described. The output control signal 1 is connected to a gate of the input SW 701 in both outputs $Y_{4M+1}$ and $Y_{4M+2}$. The GND short-circuit signal 1 is connected to the gate of the ground short-circuit SW 209 in both outputs $Y_{4M+1}$ and $Y_{4M+2}$. The VCC short-circuit signal 1 is connected to the gate of the VCC short-circuit SW 210 in the output $Y_{4M+1}$, and is connected to the gate of the −VCC short-circuit SW 211 in the output $Y_{4M+2}$. The VCC short-circuit signal 2 is connected to the gate of the −VCC short-circuit SW 211 in the output $Y_{4M+1}$, and is connected to the gate of the VCC short-circuit SW 210 in the output $Y_{4M+2}$.

The output control signal 2 is connected to a gate of the input SW 701 in both outputs $Y_{4M+3}$ and $Y_{4M+4}$. The GND short-circuit signal 2 is connected to the gate of the ground short-circuit SW 209 in both outputs $Y_{4M+3}$ and $Y_{4M+4}$. The VCC short-circuit signal 3 is connected to the gate of the VCC short-circuit SW 210 in the output $Y_{4M+3}$, and is connected to the gate of the −VCC short-circuit SW 211 in the output $Y_{4M+4}$. The VCC short-circuit signal 4 is connected to the gate of the −VCC short-circuit SW 211 in the output $Y_{4M+3}$, and is connected to the gate of the VCC short-circuit SW 210 in the output $Y_{4M+4}$. With this configuration, the short-circuit operation may be realized only at columns in which polarities are inverted, even when the polarity inversion lines of the outputs $Y_{4M+1}$ and $Y_{4M+2}$ and the outputs $Y_{4M+3}$ and $Y_{4M+4}$ are located at positions different from each other.

Figure 10:
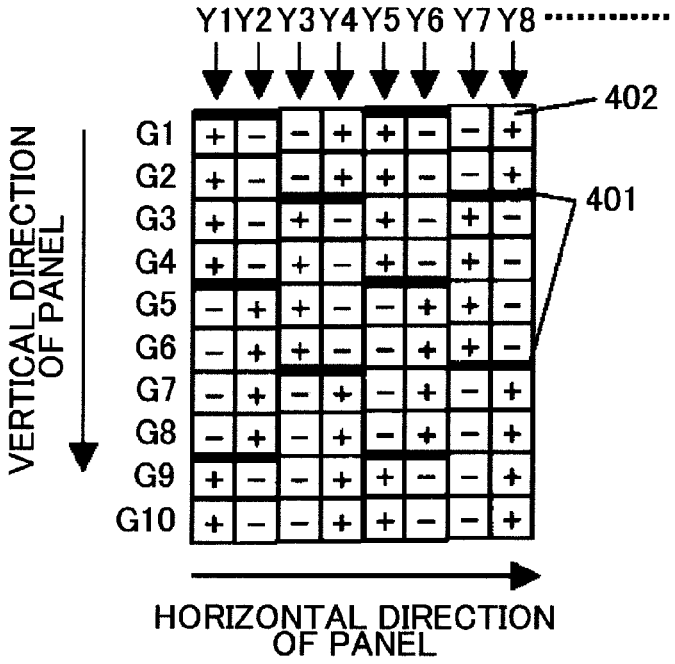
FIG. 10 is a diagram for describing a polarity distribution in the liquid crystal display device according to the fourth embodiment of the present invention when 1×4 dot inversion drive is performed.
Figure 11:
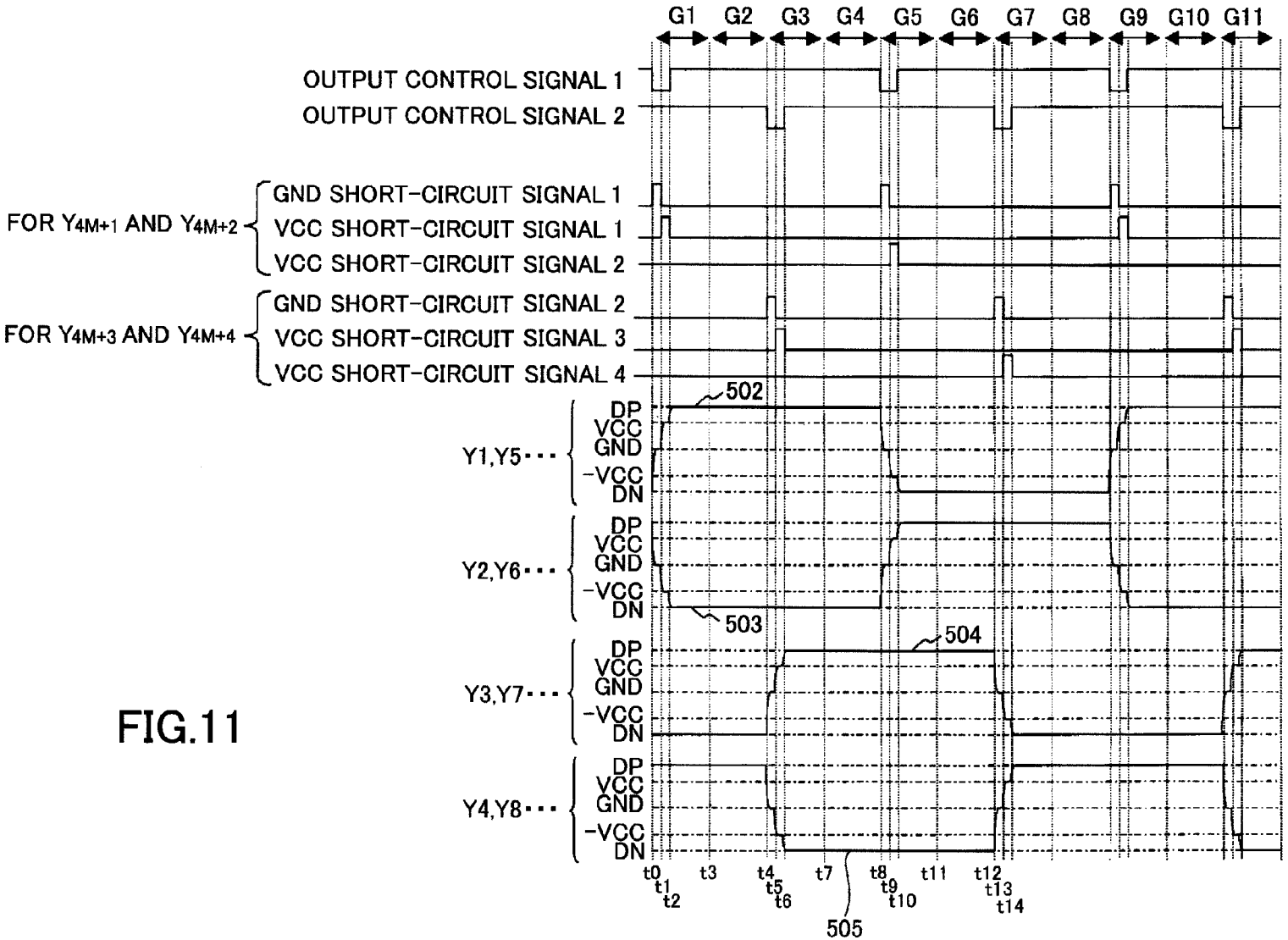
FIG. 11 is a timing chart of signal lines of the short circuit of the liquid crystal display device according to the fourth embodiment of the present invention when 1×4 dot inversion drive is performed.
Figure 12:
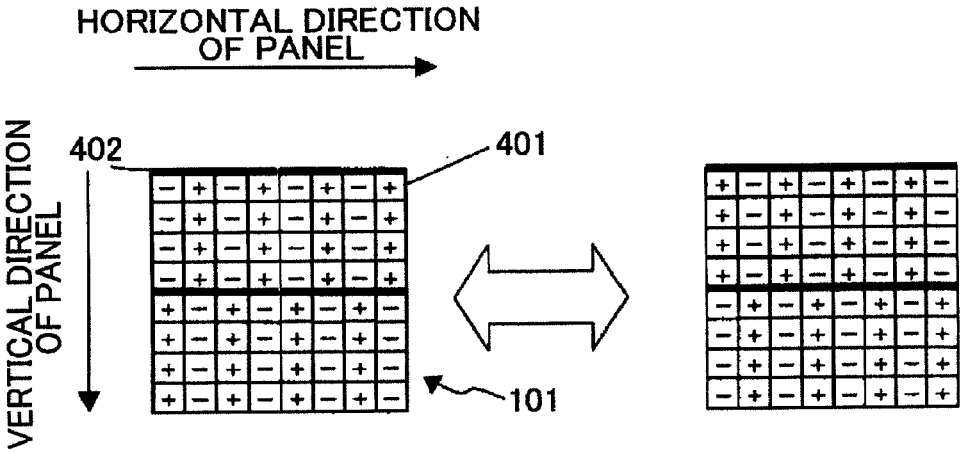
FIG.12 PRIOR ART
FIG. 12 is a diagram for describing a polarity distribution in a conventional liquid crystal display device when 1×4 dot inversion drive is performed.
Figure 13:
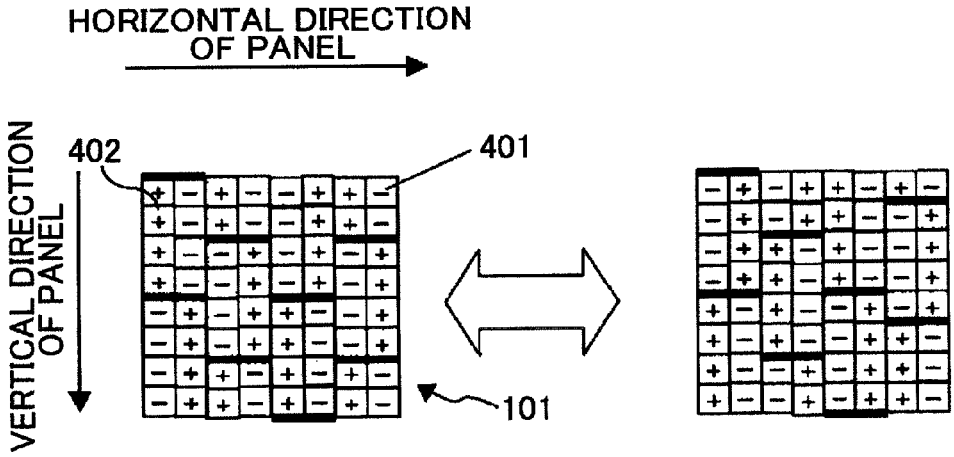
FIG.13 PRIOR ART
FIG. 13 is a diagram for describing a polarity distribution in another conventional liquid crystal display device when 1×4 dot inversion drive is performed.
Figure 14:
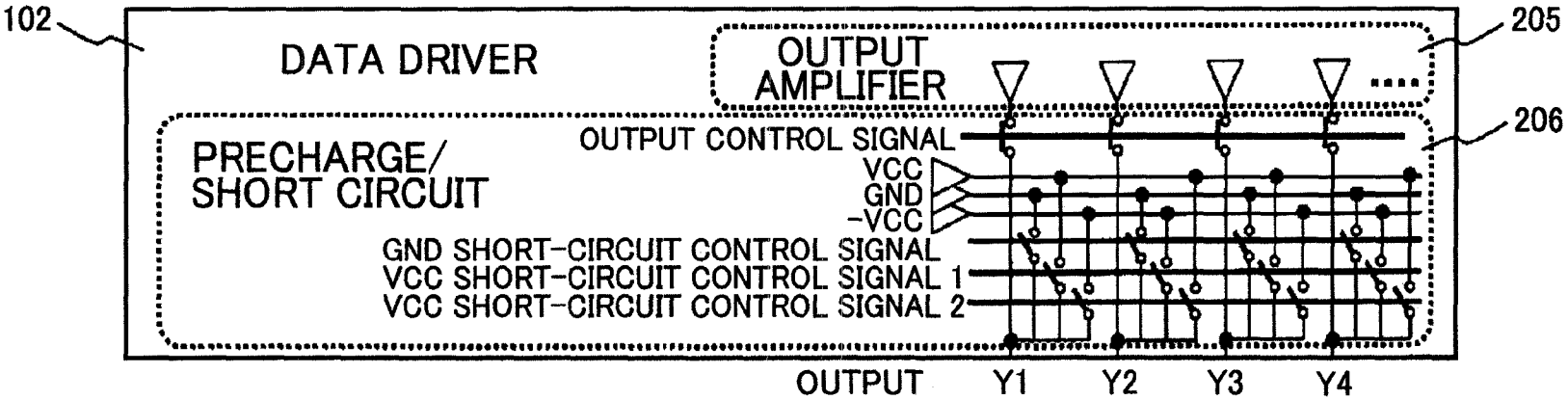
FIG.14 PRIOR ART
FIG. 14 is a diagram for describing inner configuration of a data driver of a still another conventional liquid crystal display device.
Figure 15:
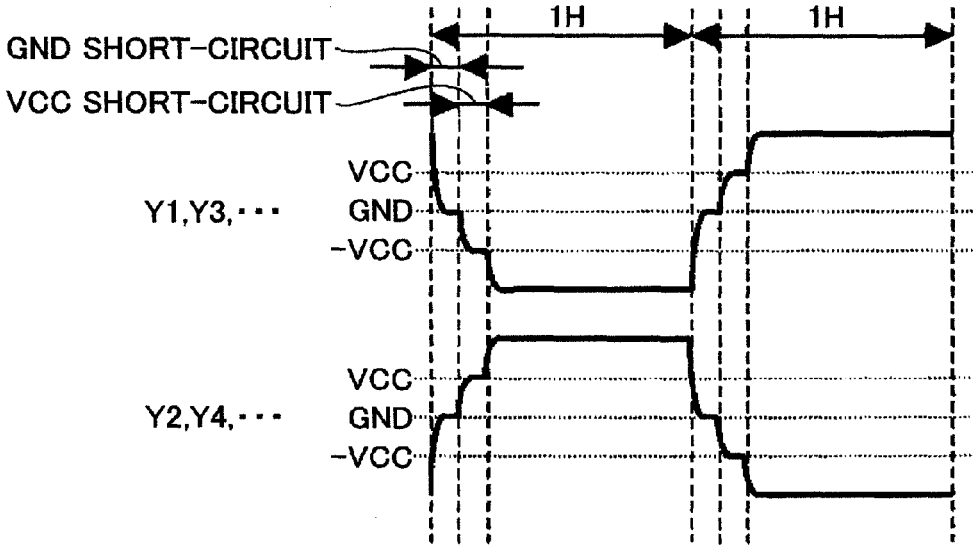
FIG.15 PRIOR ART
FIG. 15 is a timing chart of signal lines of a short circuit of the still another conventional liquid crystal display device when 1×4 dot inversion drive is performed.

FIG. 10 is a diagram for describing a polarity distribution of the liquid crystal display device according to the fourth embodiment of the present invention when 1×4 dot inversion drive is performed. FIG. 11 is a timing chart of the signal lines of the short circuit in the liquid crystal display device according to the fourth embodiment of the present invention when 1×4 dot inversion drive is performed. Hereinafter, with reference to FIGS. 9 to 11, an operation of the short circuit of the fourth embodiment is described. Note that, FIG. 10 is a diagram enlarging a part of a region of the liquid crystal panel, in which "+" and "−" indicate polarities. Each of "+" and "−" corresponds to one of the pixels (sub-pixels) of RGB. Further, scanning timings of a G1 line, a G2 line, a G3 line, . . . illustrated in FIG. 10 correspond to a G1 period, a G2 period, a G3 period, . . . that is, each 1 horizontal cycle (1H cycle), illustrated in FIG. 11.

Also in the short circuit of the fourth embodiment, the output control signal 1 becomes LOW for every 4 horizontal cycles (4H cycles) so as to turn OFF the input SWs 701. The output control signal 1 becomes LOW in the period T1 when the outputs $Y_{4M+1}$ and $Y_{4M+2}$ are short-circuited to the ground and in the period T2 when the outputs $Y_{4M+1}$ and $Y_{4M+2}$ are short-circuited to VCC, in the G1 period, the G5 period, the G9 period, . . . . Further, the output control signal 2 becomes LOW for every 4 horizontal cycles (4H cycles) so as to turn OFF the input SWs 701. The output control signal 2 becomes LOW in the period T1 when the outputs $Y_{4M+3}$ and $Y_{4M+4}$ are short-circuited to the ground and in the period T2 when the outputs $Y_{4M+3}$ and $Y_{4M+4}$ are short-circuited to VCC in the G3 period, the G7 period, the G11 period, . . . .

Note that, the GND short-circuit signals 1 and 2 and the VCC short-circuit signals 1 to 4 may be controlled by methods similar to the control methods of the first embodiment.

That is, in the short circuit of the fourth embodiment, in a period from the time t0 to the time t2 and in a period from the time t8 to the time t10, the input SWs 701 which electrically connect the inputs $X_{4M+3}$ and $X_{4M+4}$ of the short circuit, in which the polarity inversion is not performed, and the outputs $Y_{4M+3}$ and $Y_{4M+4}$ remain in the ON state. Therefore, gray scale voltages which are supplied from the decoding circuit are output from the outputs $Y_{4M+3}$ and $Y_{4M+4}$ and hence the voltage level of the data lines in the liquid crystal array may be maintained at the gray scale voltage.

Similarly, in a period from the time t4 to the time t6 and in a period from the time t12 to the time t14, the input SWs 701 which electrically connect the inputs $X_{4M+1}$ and $X_{4M+2}$ of the short circuit, in which the polarity inversion is not performed, and the outputs $Y_{4M+1}$ and $Y_{4M+2}$ remain in the ON state. Therefore, the gray scale voltages which are supplied from the decoding circuit are output from the outputs $Y_{4M+1}$ and $Y_{4M+2}$ and hence the voltage level of the data lines in the liquid crystal array may be maintained at the gray scale voltage.

With the features described above, it is possible to suppress variations of the output drain lines in the columns in which the short-circuit operation is not performed, which are otherwise caused by influence of the output variations (influence of coupling) in the columns in which the short-circuit operation is performed in the short-circuit period. As a result, it is possible to suppress power supply by the amount of variations of the output drain lines in the columns in which the short-circuit operation is not performed, and hence deterioration of the image quality may be further suppressed and power consumption may be reduced.

Further, similarly to the first embodiment, it is possible to realize the short-circuit operation only when the polarities are inverted in each column, and therefore similar effects as those of the liquid crystal display device of the first embodiment may be obtained.

Note that, the configuration of the liquid crystal display device of the fourth embodiment is different from that of the first embodiment merely in that the input SWs 701 which connect the inputs X1, X2, . . . Xm (where m is a natural number) and the outputs Y1, Y2, . . . Ym of the short circuit include the input SW 701 controlled by the output control signal 1 and the input SW 701 controlled by the output control signal 2. Therefore, the configuration is also applicable to the polarity inversion line dispersion type 1×2 dot inversion drive of the second embodiment and the polarity inversion line dispersion type 1×8 dot inversion drive of the third embodiment. Also in this case, the effects described above may be obtained.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a pixel array including a plurality of pixels arranged in matrix, the plurality of pixels forming pixel rows and pixel columns;

a data driver circuit for supplying gray scale voltages in accordance with display data to the plurality of pixels;

a short circuit disposed for respective outputs of the data driver circuit, the short circuit including switching elements for connecting each of the outputs to a precharge voltage different from an output voltage; and a scanning circuit for supplying a scanning signal for selecting, from among the plurality of pixels, pixels in a line unit of each of the pixel rows, the liquid crystal display device employing a dot inversion drive method which inverts polarities of the gray scale voltages for at least every 2 pixel rows, wherein:

the short circuit includes the switching elements each disposed in one of a first switching group and a second switching group;

each switching element of one of the first switching group and the second switching group is connected to respective pairs of pixel column units including an odd-numbered pixel column and an even-numbered pixel column which are adjacent to each other;

the pairs of pixel column units which are adjacent to each other are each connected to one of the switching elements disposed in respective switching groups different from each other, and the first switching group includes a first ground short-circuit switch, a second ground short-circuit switch, a first VCC short-circuit switch, a second VCC short-circuit switch, a first −VCC short-circuit switch and a second −VCC short-circuit switch, the second switching group includes a third ground short-circuit switch, a fourth ground short-circuit switch, a third VCC short-circuit switch, a fourth VCC short-circuit switch, a third −VCC short-circuit switch and a fourth −VCC short-circuit switch, a first VCC short-circuit signal is connected to a gate of the first VCC short-circuit switch and a gate of the second −VCC short-circuit switch, a second VCC short-circuit signal is connected to a gate of the second VCC short-circuit switch and a gate of the first −VCC short-circuit switch, a third VCC short-circuit signal is connected to a gate of the third VCC short-circuit switch and a gate of the fourth −VCC short-circuit switch, and a fourth VCC short-circuit signal is connected to a gate of the fourth −VCC short-circuit and a gate of the third −VCC short-circuit.

2. The liquid crystal display device according to claim 1, wherein the pairs of pixel column units which are adjacent to each other have polarity inversion lines across which the polarities of the gray scale voltages in each of the pixel rows are inverted, the polarity inversion lines being located at positions different from each other.

3. The liquid crystal display device according to claim 1, wherein the switching element of the first switching group and the switching element of the second switching group are turned ON for different periods of time.

4. The liquid crystal display device according to claim 1, wherein:

when the outputs of the data driver circuit are Y1 to Yk, where k≥4, the outputs of the data driver circuit include:

an output pair Yj and Yj+1, where j=1, 3, . . . k−1, having the same polarity inversion line and the polarities opposite to each other; and an output pair Yj' and Yj'+1, where j'=1, 3, . . . k−1, having the same polarity inversion line and the polarities opposite to each other; and the polarity inversion line of the output pair Yj and Yj+1 and the polarity inversion line of the output pair Yj' and Yj'+1 are adjacent output pairs and are located at positions different from each other.

5. The liquid crystal display device according to claim 1, wherein:

the pixel array is driven by the 1×N dot inversion drive method, where N≥2, of a polarity inversion line dispersion type; and each of the plurality of pixels has a polarity inversion cycle which is 2N frame cycle.

6. The liquid crystal display device according to claim 1, wherein the polarity inversion lines are shifted in a direction of the pixel columns on successive frames.

7. A liquid crystal display device, comprising:

a pixel array including a plurality of pixels arranged in matrix;

a data driver circuit for supplying gray scale voltages in accordance with display data to the plurality of pixels;

a short circuit for short-circuiting respective outputs of the data driver circuit to a precharge voltage different from an output voltage; and a scanning circuit for supplying a scanning signal to the plurality of pixels, for selecting, from among the plurality of pixels, pixels to be supplied with the gray scale voltages in a row unit, the liquid crystal display device employing a 1×N dot inversion drive method, where N≥2, which inverts polarities of the gray scale voltages in the pixel array for every plurality of lines, wherein:

the 1×N dot inversion drive method, where n≥2, comprises of a polarity inversion line dispersion type which has polarity inversion lines located at positions different in respective columns;

the 1×N dot inversion drive method, where N≥2, of the polarity inversion line dispersion type has a polarity pattern that, among a number of outputs 4M+4, where M is an integer equal to or larger than 0, of the data driver circuit, a pair of an output 4M+1 and an output 4M+2 has the same polarity inversion line, a pair of an output 4M+3 and an output 4M+4 has the same polarity inversion line, and the polarity inversion line of the pair of the output 4M+1 and the output 4M+2 and the polarity inversion line of the pair of the output 4M+3 and the output 4M+4 are shifted by N/2 lines, and the short circuit includes switching elements each disposed in one of a first switching group and a second switching group, the first switching group includes a first ground short-circuit switch, a second ground short-circuit switch, a first VCC short-circuit switch, a second VCC short-circuit switch, a first −VCC short-circuit switch and a second −VCC short-circuit switch, the second switching group includes a third ground short-circuit switch, a fourth ground short-circuit switch, a third VCC short-circuit switch, a fourth VCC short-circuit switch, a third −VCC short-circuit switch and a fourth −VCC short-circuit switch, a first VCC short-circuit signal is connected to a gate of the first VCC short-circuit switch and a gate of the second −VCC short-circuit switch, a second VCC short-circuit signal is connected to a gate of the second VCC short-circuit switch and a gate of the first −VCC short-circuit switch, a third VCC short-circuit signal is connected to a gate of the third VCC short-circuit switch and a gate of the fourth −VCC short-circuit switch, and a fourth VCC short-circuit signal is connected to a gate of the fourth −VCC short-circuit and a gate of the third −VCC short-circuit.

8. The liquid crystal display device according to claim 7, wherein, when the polarity inversion lines are shifted by N/2 lines, where N≥2, N comprises one of 2, 4, 8, and 16.

9. The liquid crystal display device according to claim 7, wherein:

when the outputs of the data driver circuit are Y1 to Yk, where k≥4, the outputs of the data driver circuit include:

an output pair Yj and Yj+1, where j=1, 3, . . . k−1, having the same polarity inversion line and the polarities opposite to each other; and an output pair Yj' and Yj'+1, where j'=1, 3, . . . k−1, having the same polarity inversion line and the polarities opposite to each other; and the polarity inversion line of the output pair Yj and Yj+1 and the polarity inversion line of the output pair Yj' and Yj'+1 are adjacent output pairs and are located at positions different from each other.

10. The liquid crystal display device according to claim 7, wherein:

when the outputs of the data driver circuit are Y1 to Y4*k*, where k≥1, the outputs of the data driver circuit include:

an output Y4M+1 and an output Y4M+2, where M=0, 1, . . . k−1, having the same polarity inversion line and the polarities opposite to each other; and an output Y4M+3 and an output Y4M+4, where M=0, 1, . . . k−1, having the same polarity inversion line and the polarities opposite to each other; and the polarity inversion line of the output Y4M+1 and the output Y4M+2 and the polarity inversion line of the output Y4M+3 and the output Y4M+2 are adjacent output pairs and are located at positions different from each other.

11. The liquid crystal display device according to claim 7, wherein:

the pixel array is driven by the 1×N dot inversion drive method, where N≥2, of a polarity inversion line dispersion type; and each of the plurality of pixels has a polarity inversion cycle which is 2N frame cycle.

12. The liquid crystal display device according to claim 7, wherein the polarity inversion lines in respective columns of the pixel array are shifted in a direction of the pixel columns on successive frames.

* * * * *